US005611077A

United States Patent [19]

Ishikawa et al.

[11] Patent Number: 5,611,077

[45] Date of Patent: Mar. 11, 1997

[54] PROCESSING APPARATUS FOR COLOR PHOTOGRAPHIC MATERIAL

[75] Inventors: Takatoshi Ishikawa, Minami-ashigara; Fumio Mogi, Kanagawa-ken, both of Japan

[73] Assignee: Fuji Photo FIlm Co., Ltd., Minami-ashigara, Japan

[21] Appl. No.: 441,306

[22] Filed: May 15, 1995

[30] Foreign Application Priority Data

May 16, 1994 [JP] Japan ..... 6-101258

[51] Int. Cl.[6] ..... G03D 3/02

[52] U.S. Cl. ..... 396/630; 396/622

[58] Field of Search ..... 354/298, 324, 354/322; 159/47.3; 134/64 P, 64 R, 122 P, 122 R; 430/30, 386, 398–400

[56] References Cited

U.S. PATENT DOCUMENTS

| | | | |
|---|---|---|---|
| 4,367,941 | 1/1983 | Uenaka et al. | 354/324 |
| 4,806,962 | 2/1989 | Uchida et al. | 354/324 |
| 4,907,023 | 3/1990 | Koboshi et al. | 354/324 X |
| 4,985,118 | 1/1991 | Kurematsu et al. | 159/47.3 |
| 5,147,766 | 9/1992 | Ishikawa et al. | 430/399 |
| 5,246,819 | 9/1993 | Yoshida et al. | 430/386 |
| 5,353,085 | 10/1994 | Kurematsu et al. | 354/324 |

FOREIGN PATENT DOCUMENTS

| | | |
|---|---|---|
| 61-4057 | 1/1986 | Japan . |
| 64-15741 | 1/1989 | Japan . |
| 1-302352 | 12/1989 | Japan . |
| 1-302351 | 12/1989 | Japan . |
| 4-141645 | 5/1992 | Japan . |

*Primary Examiner*—D. Rutledge

*Attorney, Agent, or Firm*—Burns, Doane, Swecker & Mathis, LLP

[57] ABSTRACT

A processing apparatus for color photographic photosensitive materials comprises (a) processing tanks comprising a color developing tank, a desilvering tank, a washing tank and/or a stabilizing tank, (b) means for replenishing respective processing tanks, (c) means for controlling an amount of replenishing color developing solution to be charged into the color developing tank in such that an amount of overflow liquid from the color developing tank is at most 400 ml per $m^2$ of the processed color photographic photosensitive materials, (d) one storage tank for collecting overflow liquids from all of the processing tanks and (e) means for introducing all overflow liquids from the processing tanks into the storage tank. This apparatus is small-size and has only one waste liquid tank with a low cost and a stable capacity without reducing efficiency of recovering silver and generating ammonia gas.

15 Claims, 2 Drawing Sheets

PROCESSING APPARATUS FOR COLOR PHOTOGRAPHIC MATERIAL

BACKGROUND OF THE INVENTION

The present invention relates to a processing apparatus for silver halide color photographic photosensitive materials. In particular, the present invention provides a small-sized processing equipment having a reduced number of waste liquid tank.

For obtaining color prints after taking pictures with a general-purpose color negative film, roughly three processing steps, i. e. step of processing the color negative film, printing step and step of processing the color papers, are necessitated. Although centralized photofinishing laboratories for conducting the process are widely distributed, mini-labs for processing photosensitive materials within the shops are recently increasing in number. Such a mini-lab usually possesses two processing machines, i. e. a film-processing machine for conducting a step of processing the color negative film and a printer-processor for continuously conducting the printing step and color paper-processing step. However, the placement of such two processing machines in a small shop has a problem of the space. It is apparently demanded under these circumstances to develop a processing machine necessitating as little space as possible and having a high processing capacity.

The factors in determining the size of the processing machine are supposedly the processing time, processing capacity (size of the processing tank), replenisher tank, waste liquid tank, etc., but it is difficult to drastically change the processing time, in view of the compatibility of the photosensitive materials of photosensitive material makers and, in addition, a considerable processing capacity is required by the users. Therefore, for designing a processing machine as small as possible, it is important to design the replenisher tank and waste liquid tanks to be smaller. The film-processing machine and paper-processing machine each have two waste liquid tanks, and four waste liquid tanks in total, as described in Japanese Patent Unexamined Published Application (hereinafter referred to as "J. P. KOKAI") No. Sho 61-4057, so that the silver-containing waste liquid can be collected separately from the silver-free waste liquid. Namely, since silver can be recovered from the silver-containing waste liquid and reused, the waste liquid is valuable and a money is paid for the liquid depending on the silver content.

However, the price of the silver-containing waste liquid varies depending not only on the total silver content but also on the silver concentration. Namely, when the total amount of silver is fixed, the higher the concentration, the higher the recovery efficiency and the higher the price. Therefore, efforts are made to collect the waste water having a concentration as high as possible. For this reason, the silver-containing waste liquid is collected separately from the silver-free waste liquid.

Usually, since a silver-containing fixing solution and bleach-fixing solution have a high ammonium ion content, it was found that when a waste liquid having a high pH such as that from a color-developer is mixed in a waste liquid from such a silver-containing fixing solution or bleach-fixing solution, ammonia gas is generated to give off an unpleasant smell and the photosensitive material is fogged with the gas. Thus, it has been difficult in the prior art to collect all the waste liquids in only one kind of waste liquid-recovering tank. This problem is particularly serious in a processing machine containing waste liquid tanks therein.

When the waste liquid tanks are filled to capacity, the alarm is given to suggest the necessity of tank exchange or removal of the waste liquid. In this connection, when many waste liquid tanks are used, the cost of the warning system is high and the waste liquid must be frequently removed, which is undesirable in the course of the operation.

A processing apparatus having a film-processing machine and paper-processing machine unified for reducing the size thereof is disclosed in J. P. KOKAI Nos. Sho 64-15741 and Hei 4-141645. Such an idea is indeed effective in making the processing machine smaller. Further, the present invention proposes a technique of using only one waste liquid tank in order to further reduce the size of the processing machine.

SUMMARY OF THE INVENTION

A primary object of the present invention is to provide a small-sized processing machine having only one waste liquid tank. Another object of the invention is to provide a small-sized processing machine of a low cost and a stable capacity without reducing efficiency of recovering silver and generating ammonia gas.

These and other objects of the present invention will be apparent from the following description and Examples.

After intensive investigations, the inventors have found that the above-described object can be attained by a processing apparatus for color photographic photosensitive materials which comprises (a) processing tanks comprising a color developing tank, a desilvering tank, a washing tank and/or a stabilizing tank, (b) means for replenishing respective processing tanks, (c) means for controlling an amount of replenishing color developing solution to be charged into the color developing tank in such that an amount of overflow liquid from the color developing tank is at most 400 ml per $m^2$ of the processed color photographic photosensitive materials, (d) one storage tank for collecting overflow liquids from all of the processing tanks and (e) means for introducing all overflow liquids from the processing tanks into the storage tank.

DESCRIPTION OF THE PREFERRED EMBODIMENTS

The detailed description will be made on the present invention.

The processing tanks may comprise one or more color developing tanks, one or more desilvering tanks, one or more washing tanks and/or stabilizing tanks. In this connection, the desilvering tank may comprises a bleach-fixing tank (i.e., blix tank), bleaching tank and/or fixing tank. The capacity of the respective processing tanks is about 1 l to 20 l. The processing tanks are also called as processing baths.

Examples of the means for replenishing respective processing tanks include respective replenishing tanks for the processing tanks, for example, a replenishing tank for the color developing tank, a replenishing tank for the desilvering tank and so on, respective containers or cartridges containing a replenishing solution to be charged into the processing tanks, and a combination of a water replenishing tank for respective processing tank and supply device of tablets or powders of the ingredients for the preparation of the respective replenishing solution.

Examples of the means for controlling an amount of replenishing color developing solution includes flow control devices such as a flow control valve.

This means can work based on the information about the amount of the processed silver halide color photographic photosensitive materials. This information can easily be obtained by use of means for integrating an amount of processed color photographic photosensitive materials. The amount of the processed color photographic photosensitive materials can be determined by use of infrared rays.

The term "storage tank" herein indicates a tank for temporarily collecting a waste liquid overflowing from processing tanks. The tank is also referred to as "a waste liquid tank". Overflowing liquids from the processing tanks such as developer(developing solution), bleaching solution, fixing solution, bleach-fixing solution, washing water, stabilizing solution, etc. are collected therein.

The capacity of the storage tank for collecting the waste liquid is about 100 ml to 50 l, preferably 1 to 30 l. When the capacity is below this range, the frequency of exchanging the tank is increased and, on the contrary, when it is above this range, the space to be occupied by the processing apparatus becomes large and the transportation efficiency is worse. Thus, the tank must be designed so as to have an optimum capacity.

Figure 1:
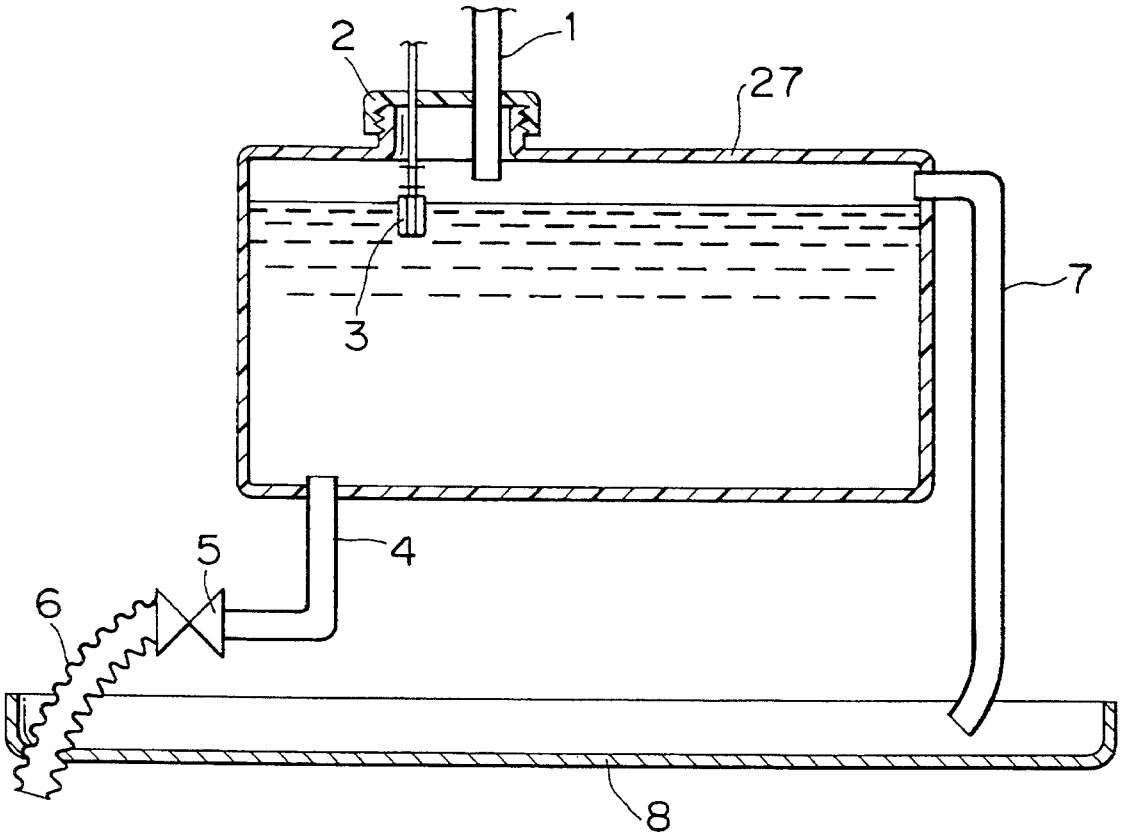
FIG. 1 is a horizontal section of a tank for collecting the waste liquid used in the present invention.

The storage tank preferably has an alarm device which senses that the tank is filled to capacity and alarms, as shown in FIG. 1. It is particularly preferred that the tank is so designed that the alarm is given when the tank content has reached about 80 to 95% of the capacity. A sensor for alarming the filling of the tank to capacity is preferably that of a float switch or electrode system. The waste liquid tank may have a cock so as to facilitate the recovery of the waste liquid from the tank. In this case, the storage may be positioned at a height of several ten centimeters to about one meter from the floor and a commercially available plastic tank or the like is placed below the waste liquid tank to facilitate the removal of the waste liquid. Further, a fail-safe drain line can be provided for leading an overflow of the waste liquid into a safe place without leakage when the sensor for alarming that the tank is full is out of order. The overflow is thus led to a drain pan below the equipment.

Examples of the means for introducing all overflow liquids from the processing tanks into the storage tank includes pipe lines made from plastics or metals. The means each is connected to respective processing tanks in order to charge the overflow liquids (i.e., waste liquids) into the storage tank.

The apparatus may further comprise (f) means for controlling amounts of replenishing solutions other than the replenishing color developing solution in such that a liquid collected in the storage tank has a silver content of 3 to 20 g/l.

In FIG. 1, reference numeral 1 represents an inlet for the waste liquid, 2 represents a cap of the waste tank, 3 represents a float sensor for alarming that the tank is full, 4 represents an outlet for the waste liquid, 5 represents a cock for discharging the waste liquid, 6 represents a flexible cock, and 7 represents a fail-safe drain line, which leads the waste liquid into a drain pan 8 in case of an emergency.

Examples of the methods for detecting that the waste liquid tank is full and methods for the alarming are given below.

Although it is preferred that the waste liquid-collecting tank used in the present invention is positioned within the processing apparatus from the viewpoints of the reduction in the space to be occupied by the apparatus and the appearance, the tank may be placed near the apparatus, if necessary. An example of the placement of the waste liquid tank in a film-processing machine is shown in FIG. 2.

Figure 2:
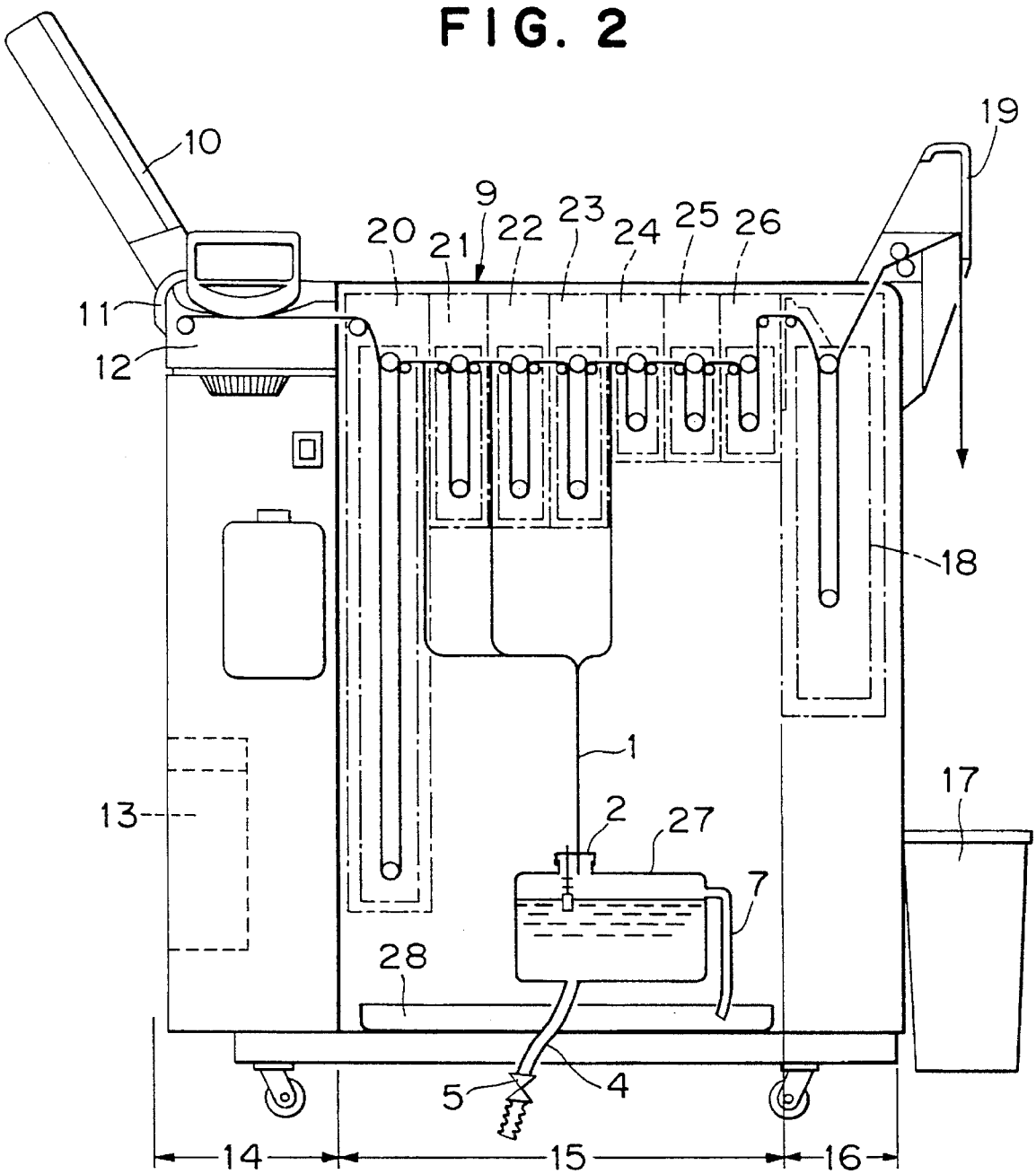
FIG. 2 is a horizontal section of an embodiment of a processing apparatus used in the present invention, wherein the reference numeral 1 represents an inlet, 2 represents a cap of a collecting tank, 3 represents a float sensor, 4 represents an outlet, 5 represents a discharge cock, 6 represents a flexible cock, 7 represents a drain line, 9 represents a film processor, 20 through 26 each represents a processing tank, and 27 represents a tank for collecting the waste liquid.

In FIG. 2, reference numeral 9 represents a film-processing machine, 10 represents a film cassette, 11 represents a film-inserting part, 12 represents a cutter, 13 represents a patrone-receiving box, 14 represents a film-inserting part, 15 represents a processing part, 16 represents a drying part, 17 represents a film-receiving box, 18 represents a drying part, 19 represents a processed film-accumulating part, 20 represents a developing tank, 21 to 23 each represent a bleach-fixing tank, 24 to 26 each represent a stabilizing bath, 17 represents a waste liquid-collecting tank, and 28 represents a drain pan.

The materials used for producing the waste liquid tank are preferably resins such as polyethylene, polyvinyl chloride, polypropylene, polyphenylene oxide, polyphenylene sulfide, polymethylpentene, polyether ether ketone, polyalkylene terephthalate, polyether imide, polyethersulfone and polysulfone resins and fluororesin. The waste liquid tank can be produced by blow molding or injection molding method.

The detailed description will be made on the processing apparatus of the present invention.

The processing apparatus of the present invention is preferably a machine for processing a color negative film or a machine for processing a color paper. In this connection, the above-mentioned apparatus having (c) means for controlling an amount of replenishing color developing solution to be charged into the color developing tank in such that an amount of overflow liquid from the color developing tank is at most 400 ml, preferably 100 ml to 300 ml per $m^2$ of the processed color photographic photosensitive materials is preferably used for processing color photographic negative films. On the other hand, the above-mentioned apparatus having (c) means for controlling an amount of replenishing color developing solution to be charged into the color developing tank in such that an amount of overflow liquid from the color developing tank is at most 20 ml, preferably 2 to 15 ml per $m^2$ of the processed color photographic photosensitive materials is preferably used for processing color photographic papers. There can be used two apparatuses, one being for processing color photographic negative films and the other being for processing color photographic papers. However, particularly when both machines are combined to form a unified structure, the processing apparatus can be reduced in size, so that this is a preferred embodiment of the present invention. The term "combine to form a unified structure" herein indicates that both processing machines are arranged in one casing.

In this case, a color negative film and a color paper can be processed in the same bath, with the proviso that the color developing solution for the color film is preferably different from that for the color paper. The processing solutions used for the desilverization step and thereafter may be common to both color film and color paper. Typical processing steps will be described below, which by no means limit the invention.

For Example, there can be used a processing apparatus for color photographic photosensitive materials which comprises (a) two series of processing tanks comprising a color developing tank, a desilvering tank, a washing tank and/or a stabilizing tank, the one being first series for processing color photographic negative films and the other being second series for processing color photographic papers, (b) means for replenishing respective processing tanks, (c-1) means for controlling an amount of replenishing color developing solution to be charged into the color developing tank of the first series in such that an amount of overflow liquid from the color developing tank is at most 400 ml per $m^2$ of the processed color photographic negative films, (c-2) means for controlling an amount of replenishing color developing solution to be charged into the color developing tank of the second series in such that an amount of overflow liquid from the color developing tank is at most 20 ml per $m^2$ of the processed color photographic papers, (d) one storage tank for collecting overflow liquids from all of the processing tanks and (e) means for introducing all overflow liquids from the processing tanks into the storage tank. In this connection, the processing tanks of the first series may be common with the corresponding processing tanks of the second series except for respective color developing tanks. This apparatus may further comprise (g-1) means for integrating an amount of processed color photographic negative films and (g-2) means for integrating an amount of processed color photographic papers.

The respective processing baths may comprise two or more tanks arranged to form a cascade system.

The term "one kind" herein does not indicate that two or more collecting tanks are provided depending on the kinds of the waste liquids but it indicates that two or more kinds of the waste liquids are collected in only one recovering tank.

The description will be made on the waste liquid of the present invention.

The term "waste liquids" herein indicates the processing solutions overflowed from the above-described processing baths. The overflow is caused because a predetermined amount of a replenisher is used depending on the amount of the processed photosensitive material, so that the amount of the waste liquid is closedly related to the amount of the replenisher.

Namely, the total amount of the waste liquid is roughly calculated as follows: (the total amount of the waste liquid)=(the total amount of the replenisher)−[(amount of evaporation)+(amount of replenisher entrained by the photosensitive material)]. Therefore, for reducing the amount of the waste liquid, it is important to reduce the amount of the replenisher. The smaller the amount of the replenisher in each processing bath, the better. The details will be described below.

Among the waste liquids in the present invention, the term "silver-containing waste liquid" indicates a waste liquid having a silver concentration of at least 0.05 g/l. The upper limit of the silver concentration is 20 g/l. Such processing solutions include a fixing solution, bleach-fixing solution, as well as a rinse (a small amount of washing water) and stabilizing solution used after using these baths. The term "silver-free waste liquid" indicates a waste liquid having a silver concentration of below 0.05 g/l, such as a color developer, bleaching solution and stabilizer.

When all of the above-described waste liquids are collected in the form of a mixture of them in an ordinary processing method, the silver ion concentration in the waste liquid mixture is lowered to below 2 g/l, which is undesirable from the viewpoint of the silver-recovering efficiency. On the contrary, in the present invention wherein the amount of the replenisher in each of the processing baths is controlled as will be described below, the silver concentration in the mixed waste liquid can be kept in the range of 3 to 20 g/l, preferably 4 to 15 g/l even when all the waste liquids are collected in only one waste liquid tank. Thus, there can be kept a silver concentration equal to or above that obtained in the conventional process wherein only the silver-containing waste liquid is separatedly collected.

In addition, in the conventional method, the pH of a mixture obtained by mixing all the waste liquids is elevated to 7 or above due to the waste liquid from the color developer and, therefore, ammonia gas is generated in the waste water tank. However, in the present invention wherein the amount of the waste liquid from the color developer is limited, the pH of the liquid in the waste liquid tank can be kept in the range of 6.5 to 3.0, preferably 6.0 to 4.0, and the undesirable ammonia gas is scarcely generated. Thus good results are obtained in the present invention.

The detailed description will be made on the processing solutions used in the present invention.

The color developer (developing solution) used in the processing apparatus of the present invention contains a known aromatic primary amine as the color developing agent. Preferred examples of the aromatic primary amines are p-phenylenediamine derivatives. Typical examples thereof include N,N-diethyl-p-phenylenediamine, 2-amino-5-diethylaminotoluene, 2-amino-5-(N-ethyl-N-laurylamino-)toluene, 3-methyl-4-[N-ethyl-N-(β-hydroxyethyl)amino]aniline, 3-methyl-4-[N-ethyl-N-(δ-hydroxybutyl)amino]aniline, 2-methyl-4-[N-ethyl-N-(β-hydroxyethyl)amino]aniline, 4-amino-3-methyl-N-ethyl-N-[β-(methanesulfonamido)ethyl]-aniline, N-(2-amino-5-diethylaminophenylethyl)methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline. Particularly preferred is 4-amino-3-methyl-N-ethyl-N-[β-(methanesulfonamido)ethyl]aniline, 2-methyl-4-[N-ethyl-N-(β-hydroxyethyl)amino]aniline or 2-methyl-4-[N-ethyl-N-(β-hydroxybutyl)amino]aniline.

Among the above-listed compounds, 4-amino-3-methyl-N-ethyl-N-[β-(methanesulfonamido)ethyl]-aniline and 3-methyl-4-[N-ethyl-N-(β-hydroxyethyl)amino]aniline are preferred for obtaining excellent photographic characteristics.

Such a p-phenylenediamine derivative may be in the form of its salt such as sulfate, hydrochloride, sulfite or p-toluenesulfonate. The aromatic primary amine developing agent must be used in an amount of at least about 0.05 mol/l, and it is preferably 0.10 to 0.50 mol/l, per liter of the color developer. In order to reduce the amount of the replenisher as far as possible and therefore to reduce the amount of the waste liquid, the color developer replenisher having a high concentration must be used and the amount thereof is preferably about 0.17 to 1.00 mol, more preferably about 0.2 to 0.8 mol, per liter of the replenisher.

In order to keep the silver concentration of the waste liquid on a high level and to inhibit the formation of ammonia gas from the waste liquid, the amount of the color developer-replenisher is preferably as small as possible. Concretely, in processing color negative films having a high silver content in its coating, the amount of the replenisher is about 50 to 450 ml/$m^2$, preferably about 100 to 300 ml/$m^2$.

In processing color papers, the amount of the replenisher is about 30 to 70 ml, preferably about 35 to 60 ml per $m^2$ of the photosensitive material.

The amount of the waste liquid which varies depending on the amount thereof entrained by the photosensitive material and the amount of the evaporation is usually about 0 to 400 ml/$m^2$ in processing the color negative films and about 0 to 20 ml/$m^2$ in processing the color papers.

To make up a reduction in the activity of the developer caused by the reduction in amount of the replenisher, the temperature in the processing with the color developer is preferably relatively high. In particular, the processing temperature is in the range of 39° to 55° C., most preferably 40° to 45° C. in both cases.

The color developer used in the present invention can contain hydroxylamine or a sulfite ion as an antioxidant and it preferably contains also an organic preservative.

The term "organic preservative" herein indicates any of organic compounds capable of reducing the deterioration velocity of the aromatic primary amine color developing agent when it is added to a processing solution for the photosensitive material for the color photography. Namely, they are organic compounds having a function of preventing the oxidation of the color developing agent by air or the like. Among them, examples of particularly effective organic preservatives include hydroxylamine derivatives, hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds and amines having a condensed ring. Particularly preferred are alkanolamines such as triethanolamine, dialkylhydroxylamines such as N,N-diethylhydroxylamine and N,N-di(sulfoethyl)-hydroxylamine, hydrazine derivatives such as N,N-bis(carboxymethyl)hydrazine, and aromatic polyhydroxy compounds such as sodium catechol-3,5-disulfonate.

An antifoggant can be added, if necessary, to the color developer used in the present invention. The antifoggants usable herein include alkali metal halides such as sodium chloride, potassium bromide and potassium iodide and organic antifoggants. The organic antifoggants are typified by nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The color developer used in the present invention has a preferred pH range of about 9.5 to 10.5. Provided that the developing activity can be kept, the pH of the developing solution in the tank is preferably as low as possible for inhibiting the formation of ammonia gas from the waste liquid. The most preferred pH of the mother liquid is about 9.9 to 10.3.

A buffer is preferably used for keeping the pH in the above-described range. The buffers usable herein include, for example, carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishydroxyaminomethane salts and lysine salts. Particularly preferred are the carbonates and phosphates.

The amount of the buffer to be added to the developer is preferably at least 0.1 mol/l, particularly 0.1 to 0.4 mol/l.

A chelating agent can be added to the developer for inhibiting the prevention of calcium and magnesium or for improving the stability of the color developer. The chelating agents include, for example, nitrilotriacetic acid, diethylenetriaminepentaacetic acid, ethylenediaminetetraacetic acid, N,N,N-trimethylenephosphonic acid, ethylenediamine-N,N,N'N'-tetramethylenephosphonic acid, transcyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl) ethylenediamine-N,N'-diacetic acid and hydroxyethyliminodiacetic acid. These chelating agents may be used in combination of two or more of them, if necessary.

The chelating agent is added in an amount sufficient for sequestering for the developer. It is, for example, about 0.1 to 10 g per liter of the developer.

The developer used in the present invention can contain, if necessary, a development accelerator. The development accelerators include thioether compounds mentioned in Japanese Patent Publication for Opposition Purpose (hereinafter referred to as "J. P. KOKOKU") No. Sho 37-16088, 37-5987, 38-7826, 44-12380 and 45-9019 and U.S. Pat. No. 3,813,247; p-phenylenediamine compounds mentioned in J. P. KOKAI Nos. Sho 52-49829 and 50-15554, quaternary ammonium salts mentioned in J. P. KOKAI No. Sho 50-137726, J. P. KOKOKU No. 44-30074, and J. P. KOKAI Nos. Sho 56-156826 and 52-43429; amine compounds mentioned in U.S. Pat. Nos. 2,494,903, 3,128,182, 4,230,796 and 3,253,919, J. P. KOKOKU No. Sho 41-11431, U.S. Pat. Nos. 2,482,546, 2,596,926 and 3,582,346; polyalkylene oxides mentioned in J. P. KOKOKU Nos. Sho 37-16088 and 42-25201, U.S. Pat. No. 3,128,183, J. P. KOKOKU Nos. Sho 41-11431 and 42-23883 and U.S. Pat. No. 3,532,501; as well as 1-phenyl-3-pyrazolidones and imidazoles. As for benzyl alcohol, refer to the description given above.

The color developer usable in the present invention preferably contains a fluorescent brightening agent, which is preferably a 4,4'-diamino-2,2'-disulfostilbene compound. It is used in an amount of 0 to 5 g/l, preferably 0.1 to 4 g/l.

The color development time which is not particularly limited is usually about 10 seconds to 4 minutes, preferably 15 seconds to 2 minutes.

In the processing machine of the present invention, the development step is followed by a desilverization process. An example of the desilverization steps of the present invention is as follows, which by no means limits the invention:

(step 1) bleaching/fixing, (step 2) bleach-fixing, (step 3) bleaching/bleach-fixing, (step 4) bleaching/bleach-fixing/fixing, (step 5) fixing/bleach-fixing, and (step 6) fixing.

Each of the bleaching, bleach/fixing and fixing may be conducted in a cascade system in two or more separated baths, if necessary, or the mother solution and replenisher for processing the color negative films may be in common with those for processing the color papers.

Various bleaching agents are usable for preparing the bleaching solution and bleach-fixing solution to be used in the processing machine of the present invention. They include, for example, hydrogen peroxide, persulfates, potassium ferricyanide, dichromates, iron chlorides and ferric aminopolycarboxylates. Particularly preferred bleaching agents are the ferric aminopolycarboxylates.

Particularly preferred aminopolycarboxylic acids include EDTA, 1,3-PDTA, diethylenetriaminepentaacetic acid, 1,2-cyclohe xanediaminetetraacetic acid, iminodiacetic acid, methyliminodiacetic acid, N-(2-acetamido)iminodiacetic acid, nitrilotriacetic acid, N-(2-carboxyethyl)iminodiacetic acid, N-(2-carboxymethyl)iminodipropionic acid, β-alaninediacetic acid, ethylenediamine-N,N'-disuccinic acid, 1,3-propylenediamine-N,N'-disuccinic acid, compounds of general formula (I) given in J. P. KOKAI No. Hei 5-303186 and compounds of general formula (B) given in J. P. KOKAI No. Hei 5-188553. However, the aminopolycarboxylic acids are not particularly limited to them.

The concentration of the ferric complex salt in the bleach-fixing solution of the present invention is in the range of 0.005 to 2.0 mol/l, preferably 0.01 to 1.00 mol/l, and more preferably 0.02 to 0.50 mol/l.

The concentration of the ferric complex salt in the replenisher is preferably 0.005 to 2 mol/l, and more preferably 0.01 to 1.5 mol/l.

Various compounds can be incorporated, as bleach-accerelating agent, into the bleaching solution, bleach-fixing solution and/or pre-processing bath to be used before the solution. Those having a high bleaching power include, for example, compounds having a mercapto group or disulfido bond as described in U.S. Pat. No. 3,893,858, German Patent No. 1,290,812, J. P. KOKAI No. Sho 53-95630 and Research Disclosure No. 17129 (July, 1978), and thiourea compounds described in J. P. KOKOKU No. Sho 45-8506, J. P. KOKAI Nos. Sho 52-20832 and 53-32735 and U.S. Pat. No. 3,706,561, and halides containing iodine or bromine ion.

The bleaching solution and bleach-fixing solution usable in the present invention can contain a rehalogenating agent such as a bromide (e. g. potassium bromide, sodium bromide or ammonium bromide), a chloride (e. g. potassium chloride, sodium chloride or ammonium chloride) or an iodide (e. g. ammonium iodide). If necessary, the solution can contain one or more inorganic acids and organic acids having a pH-buffering function such as borax, sodium metaborate, acetic acid, sodium acetate, sodium carbonate, potassium carbonate, phosphorous acid, phosphoric acid, sodium phosphate, citric acid, sodium citrate and tartaric acid as well as alkali metal and ammonium salts of them, and a corrosion inhibitor such as ammonium nitrate or guanidine.

The bleaching solution and bleach-fixing solution can further contain a fluorescent brightener, defoaming agent, surfactant and organic solvent such as polyvinylpyrrolidone or methanol.

The fixing agents usable for the bleach-fixing solution or fixing solution are those known in the art. In particular, they are water-soluble silver halide-solubilizers including thiosulfates such as sodium thiosulfate and ammonium thiosulfate; thiocyanates such as sodium thiocyanate and ammonium thiocyanate; thioether compounds such as ethylenebisthioglycolic acid and 3,6-dithia-1,8-octanediol; and thioureas. They are usable either singly or in the form of a mixture of two or more of them. Further, a special bleach-fixing solution such as a combination of a fixing agent and a large amount of a halide, e. g. potassium iodide, as described in J. P. KOKAI No. Sho 55-155354 is also usable. In the present invention, a thiosulfate, particularly ammonium thiosulfate, is preferably used. If necessary, sodium thiosulfate is usable in combination with this compound. The amount of the fixing agent is in the range of preferably 0.3 to 2 mol, more preferably 0.5 to 1.0 mol, per liter of the solution.

The bleach-fixing solution or fixing solution preferably contains a preservative selected from among sulfite ion-releasing compounds, for example, sulfites (such as sodium, potassium and ammonium sulfites), hydrogensulfites (such as ammonium, sodium and potassium hydrogensulfites) and metabisulfites (such as sodium, potassium and ammonium metabisulfites). The amount of such a compound contained in the solution is preferably about 0.02 to 0.05 mol/l, more preferably 0.04 to 0.40 mol/l, in terms of sulfite ion.

Although the sulfite is usually added as the preservative to the bleach-fixing solution or fixing solution, other compounds such as ascorbic acid, carbonyl bisulfite adducts and carbonyl compounds are also usable. Benzenesulfinic acids are also effective. If necessary, the bleach-fixing solution and fixing solution can contain a buffering agent, fluorescent brightener, chelating agent, anti-foaming agent, mildew-proofing agent and so on.

The pH range of the bleaching solution or bleach-fixing solution used in the present invention is preferably 2 to 8, more preferably 3 to 6.5. The pH range of the fixing solution is preferably 4 to 8. Particularly for controlling pH of the waste liquid in the collecting tank at 6.5 or below, the above-described pH range is preferred.

To keep the silver concentration in the waste liquid on a high level, the amount of the replenisher for each of the bleaching solution, bleach-fixing solution and fixing solution is preferably as small as possible in the present invention. Namely, in processing the color negative films, the amount of the replenisher is about 50 to 400 ml, preferably 100 to 300 ml, per $m^2$ of the photosensitive material. In processing the color papers, the amount of the replenisher is about 10 to 100 ml, preferably 10 to 50 ml, per $m^2$ of the photosensitive material.

The processing temperature is about 35° to 50° C , preferably about 38° to 45° C.

The desilverization time is about 30 seconds to 3 minutes, preferably about 40 seconds to 2 minutes for the color negative films, and it is about 10 seconds to 1 minute, preferably about 15 to 30 seconds for the color papers.

In the processing machine of the present invention, the desilverization by fixing or bleach-fixing is usually followed by washing with water and/or stabilization.

The amount of the replenisher in the step of washing with water and the stabilization step is not limited. It is usually about 50 ml to 5 l per square meter of the photosensitive material. In order to attain the object of the present invention, the amount of the replenisher is desirably as small as about 1.0 to 20 parts per part of the solution brought from the preceding bath. Since the amount of the solution brought from the preceding bath is usually about 50 ml per square meter of the photosensitive material, the actual amount of the replenisher is about 50 to 1,000 ml. It is more preferably about 2 to 10 parts per part of the solution brought from the preceding bath.

The replenisher may be fed either continuously or intermittently. The solution used in the washing step and/or stabilization step may be used also in the preceding steps. For example, an overflow of the washing water or stabilizing solution reduced in amount by a multi-stage countercurrent system is introduced in the preceding fixing bath or bleach-fixing bath, and a concentrated solution is fed into the fixing bath or bleach-fixing bath to reduce the amount of the waste liquid. This is one of preferred embodiments of the present invention.

The quantity of water used in the washing step or the stabilizing solution in the stabilization step can be fixed in various ranges depending on the properties (variable depending on the substances used such as a coupler) of the photosensitive material, use of the material, solution temperature, number of the tanks (number of stages), replenishing method (countercurrent or following current) and other conditions. Usually 2 to 6 stages, particularly 2 to 4 stages, are preferred in the multistage countercurrent system.

The water very effectively usable for washing or stabilizing solution is prepared by reducing in amount of calcium and magnesium for inhibiting the propagation of bacteria as described in J. P. KOKAI No. Sho 62-288838.

The water used for washing can contain a surfactant as a hydro-extracting agent or a chelating agent typified by EDTA as a softening agent for hard water.

The photosensitive material can be processed with a stabilizing solution after the step of washing with water or without this step. The stabilizing solution contains a compound capable of stabilizing the image such as an aldehyde compound, e. g. formalin, or aldehyde-releasing compound. The compounds include hexamethylenetetramine; N-methylolazoles such as N-methylolpyrazole described in Japanese Patent Application No. Hei 3-318644; and azolylmethylamines such as N,N'-bis(1,2,4-triazol-1-yl)piperazine described in J. P. KOKAI No. Hei 4-313753. The stabilizing solution may contain a buffering agent for controlling the membrane to a pH suitable for stabilizing the dye, and an ammonium compound. If necessary, the stabilizing solution may contain a germicide and mildew-proofing agent for inhibiting the propagation of bacteria in the solution or for imparting the mildew-proofing properties to the processed photosensitive material.

Further, the stabilizing solution may contain a surfactant, fluorescent brightener and hardening agent. When the stabilization is directly conducted without the preceding step of washing with water in processing the photosensitive material in the present invention, any of known methods described in J. P. KOKAI Nos. Sho 57-8543, 58-14834, 60-220345 and so on can be employed.

In a preferred embodiment, a chelating agent such as 1-hydroxyethylidene-1,1-diphosphonic acid or ethylenediam inetetramethylenephosphonic acid, or a magnesium or bismuth compound is also used.

In the steps of washing with water and stabilization, the pH is preferably 4 to 10, more preferably 5 to 8. The temperature which varies depending on the use and properties of the photosensitive material is usually 15° to 45°, preferably 20° to 40° C. Although the time is not particularly limited, the shorter, the better for obtaining the excellent effect of the invention. It is preferably 15 seconds to 1 minute 45 seconds, more preferably 15 seconds to 1 minute.

The processing composition usable in the present invention can be in various forms. The processing agent can be in the form of one concentrated solution or two or more parts of concentrated solutions; or a powder. It can be in such a form that it is directly usable without necessitating any process. Further, the processing agent can be a combination of the concentrated solution, powder and the directly usable solution.

The description will be made on the photosensitive material usable in the present invention.

Any kind of the photosensitive materials can be processed by the present invention. Among the photosensitive materials, color negative films and color papers are preferred.

The silver halide emulsions, other substances (such as additives), layers of the photographic structure (such as layer configuration), methods for processing the photosensitive materials, and additives used for the processing according to the present invention are preferably those described in the following patents, particularly European Patent No. 0,355,660 A2 (Japanese Patent Application No. Hei 1-107011):

TABLE 1

| Photographic constituent, etc. | J.P. KOKAI No. Sho 62-215272 |
|---|---|
| Silver halide emulsion | From line 6, right upper column, p. 10 to line 5, left lower column, p. 12; and from line 4 from below, right lower column, p. 12 to line 17, left upper column, p. 13 |
| Solvent for silver halide | Lines 6 to 14, left lower column, p. 12; and from line 3 from below, left upper column, p. 13 to the last line, left lower column, p. 18 |
| Chemical sensitizer | Line 3 from below, left lower column, p. 12; line 5 from below, right lower column, p. 12; and from line 1, right lower column, p. 18, to line 9 from below, right upper column, p. 22 |
| Spectral sensitizer (spectral sensitizing method) | From line 8 from below, right upper column, p. 22 to the last line, p. 38 |
| Emulsion stabilizer | From line 1, left upper column, p. 39 to the last line, right upper column, p. 72 |
| Development accelerator | From line 1, left lower column, p. 72 to line 3, right upper column, p. 91 |
| Color coupler (cyan, magenta or yellow coupler) | From line 4, right upper column, p. 91 to line 6, left upper column, p. 121 |
| Color development improver | From line 7, left lower column, p. 121 to line 1, right upper column, p 125 |

TABLE 2

| Photographic constituent, etc. | J.P. KOKAI No. Sho 62-215272 |
|---|---|
| Ultraviolet absorber | From line 2, right upper column, p. 125 to the last line, left lower column, p. 127 column, p. 127 |
| Decoloration inhibitor (image stabilizer) | From line 1, right lower column, p. 127 to line 8, left lower column, p. 137 |
| High boiling and/or low boiling organic solvent | From line 9, left lower column, p. 137 to the last line, right upper column, p. 144 |
| Dispersion method for photographic additive | From line 1, left lower column to line 7, right upper column, p. 146 |
| Antistaining agent | From line 9, right lower column, p. 188 to line 10, right lower column, p. 193 |
| Surfactant | From line 1, left lower column, p. 201 to the last line, right upper column, p. 210 |
| Fluorine-containing compound (as antistatic agent, coating assistant, lubricant, adhesion inhibitor, etc.) | Line 1, left lower column, p. 210; and line 5, left lower column, p. 222 |

TABLE 3

| Photographic constituent, etc. | J.P. KOKAI No. Sho 62-215272 |
|---|---|
| Binder (hydrophilic colloid) | From line 6, left lower column, p. 222 to the last line, left upper column, p. 225 |
| Thickening agent | From line 1, right upper column, p. 225 to line 2, right upper column, p. 227 |
| Antistatic agent | From line 3, right upper column, p. 227 to line 1, left upper column, p. 230 |
| Hardener | From line 8, right upper column, p. 146 to line 4, left lower column, p. 155 |
| Developing agent precursor | From line 5, left lower column, p. 155 to line 2, right lower column, p. 155 |
| Development inhibitor releasing compound | Lines 3 to 9, right lower column, p. 155 |
| Support | Line 19, right lower colulmn, p. 155; and line 14, left upper column, p. 156 |

TABLE 3-continued

| Photographic constituent, etc. | J.P. KOKAI No. Sho 62-215272 |
|---|---|
| Constitution of photosensitive layers | From line 15, left upper column, p. 156 to line 14, right lower column, p. 156 |
| Dye | From line 15, right lower column, p. 156 to the last line, right lower column, p. 184 |
| Color mixing inhibitor | From line 1, left upper column, p. 185 to line 3, right lower column, p. 188 |
| Gradation controller | Lines 4 to 8, right lower column, p. 188 |
| Polymer latex | From line 2, left upper column, p. 230 to the last line, p. 239 |
| Matting agent | From line 1, left upper colum, p. 240 to the last line, right upper column, p. 240 |
| Photographic process (steps and additives) | From line 7, right upper column, p. 3 to line 5, right upper column, p. 10 |

Notes) The cited portions of J.P. KOKAI No. Sho 62-215272 includes also those amended by the Written Amendment dated Mar. 16, 1987 as stated at the end of this patent publication.

Among the above-described couplers, preferred yellow couplers are so-called short-wave type yellow couplers described in J. P. KOKAI Nos. Sho 63-231451. Sho 63-123047, Sho 63-241547, Hei 1-173499, 1-213648 and 1-250944.

TABLE 4

| Photographic constituent, etc. | J.P. KOKAI No. Hei 2-33144 | EP 0,355,660A2 |
|---|---|---|
| Silver halide emulsion | From line 16, right upper column, p. 28 to line 11, right lower column, p. 29; and lines 2 to 5, p. 30 | From line 53, p. 45 to line 3, p. 47; and lines 20 to 22, p. 47 |
| Chemical sensitizer | From line 12, right lower column, to the last line, p. 29 | Lines 4 to 9, p. 47 |
| Spectral sensitizer (spectral sensitizing method) | Lines 1 to 13, left upper column, p. 30 | Lines 10 to 15, p. 47 |
| Emulsion stabilizer | From line 14, left upper column to line 1, right upper column, p. 30 | lines 16 to 19, p. 47 |
| Color coupler (cyan, magenta or yellow coupler) | From line 14, right upper column, 3 to the last line, lsft upper column, p. 18; and from line 6, right upper column, p. 30 to line 11, right lower column, p. 35 | Lines 15 to 27, p. 4; from line 30, p. 5 to the last line, p. 28; lines 29 to 31, p. 45; and from line 23, p. 47 to line 50, p. 63 |
| Ultraviolet absorber | From line 14, right lower column, p. 37 to line 11, left upper colum, p. 38 | Lines 22 to 31, p. 65 |
| Decoloration inhibitor (image stabilizer) | From line 12, right upper column, p. 36 to line 19, left upper column, p. 37 | From line 30, p. 4 to line 25, p. 45; lines 33 to 40, p. 45; and lines 2 to 21, p. 65 |
| High boiling and/or low boiling organic solvent | From line 14, right lower column, p. 35 to line 4 from below. left upper column, p. 36 | Lines 1 to 51, p. 64 |
| Dispersion method for photographic additive | From line 10, right lower column, p. 27 to the last line, left upper column, p. 28; and from line 12, right lower column, p. 35 to line 7, right upper column, p. 36 | From line 51, p. 63 to line 56, p. 64 |

TABLE 4-continued

| Photographic constituent, etc. | J.P. KOKAI No. Hei 2-33144 | EP 0,355,660A2 |
|---|---|---|
| Antistaining agent | The last line, left upper colum, p. 37 and line 13, right lower column, p. 37 | From line 32, P. 65 to line 17, p. 66 |

TABLE 5

| Photographic constituent, etc. | J.P. KOKAI No. Hei 2-33144 | EP 0,355,660A2 |
|---|---|---|
| Surfactant | Form line 1, right upper column, p. 18 to the last line, right lower column, p 24; and from line 10 from below, left lower column, p. 27 to line 9, right lower column, p. 27 | |
| Fluorine-containing compound (as anti-static agent, coating assistant, lubricant, adhesion inhibitor, ect.) | Line 1, left upper column, p. 25 to line 9, right upper column, p. 27 | |
| Binder (hydrohilic colloid) | Lines 8 to 18, right upper column, p. 38 | Lines 23 to 28, p. 66 |
| Support | From line 18, right upper column, p. 38 to line 3, left upper dolumn, p. 39 | From line 29, p. 66 to line 13, p. 67 |
| Constitution of photosensitive layers | Lines 1 to 15, right upper column, p. 28 | Lines 41 to 52, p. 45 |
| Dye | From line 12, left upper column to line 7, right upper column, p. 38 | Lines 18 to 22, p. 66 |
| Color mixing inhibitor | Lines 8 to 11, right upper column, p. 36 | From line 57, p. 64 to line 1, p. 65 |
| Photographic process (steps and aditives | From line 4, left upper column, p 39 to the last line, left upper column, p. 42 | From line 14, p. 67 to line 28, p. 69 |

Various silver halide emulsions such as silver bromoiodide, silver chloroiodide, silver chlorobromoiodide, silver chlorobromide, silver bromide and silver chloride emulsions can be used in the present invention. The color negative film preferably has a layer containing a silver bromoiodide emulsion desirably having an iodine content of about 0.1 to 10 molar %. The color paper preferably has at least one emulsion layer containing silver halide grains comprising at least 90 molar % of silver chloride. The emulsion layer contains silver halide grains comprising more preferably 95 to 99.0 molar %, and most preferably 98 to 99.9 molar % of silver chloride. Particularly preferred is that the whole layer comprises a silver chlorobromide emulsion comprising 98 to 99.9 molar % of silver chloride. Although the amount of silver to be used for preparing the coating layers is not particularly limited, it is preferably about 2 to 10 $g/m^2$ for the color negative film, and about 0.2 to 0.9 $g/m^2$ for the color paper.

The photosensitive material used in the present invention can contain various couplers. The details are given in Tables 1 and 4.

Preferred cyan couplers include diphenylimidazole cyan couplers described in J. P. KOKAI No. Hei 2-33144, as well as 3-hydroxypyridine cyan couplers described in European Patent No. 0,333,185 A2 [particularly preferred are a cyan coupler prepared by converting a four-equivalent coupler (42) into a two-equivalent one by introducing a chlorine-linked coupling-off group, and couplers (6) and (9) mentioned therein], and cyclic active methylene cyan couplers described in J. P. KOKAI No. Sho 64-32260 (particularly preferred are Couplers 3, 8 and 34 mentioned therein).

It is preferred that a dye (particularly an oxonol dye) which can be decolored by a process as described on pages 27 through 76 of European Patent No. 0,337,490 A2 is incorporated into the hydrophilic colloid layer in such a manner that the optical reflection density of the photosensitive material will be 0.70 or above at 680 nm in order to improve the sharpness of the image, or that at least 12% by weight (more desirably at least 14% by weight) of titanium oxide surface-treated with a dihydric to tetrahydric alcohol (such as trimethylolethane) is incorporated into a water-resistant resin layer of the support.

The photosensitive material for color photography of the present invention preferably contains a compound for improving the dye image stability as described in European Patent No. 0,277,589 A2 in addition to the coupler, particularly preferably a pyrazoloazole coupler.

To inhibit the staining caused by a dye formed by, for example, the reaction of the color developing agent or an oxidation product thereof remaining in the membrane with the coupler and other side effects during the storage after the process, it is preferred to use a compound (F) which can be chemically bonded with an aromatic amine developing agent remaining after the color development to form a chemically inert, substantially colorless compound and/or a compound (G) which can be chemically bonded with an oxidation product of the aromatic amine color developing agent remaining after the color development to form a chemically inert, substantially colorless compound.

A mildew-proofing agent as described in J. P. KOKAI No. Sho 63-271247 is preferably incorporated into the photosensitive material according to the present invention in order to prevent the propagation of fungi and bacteria in the hydrophilic colloid layer, since they deteriorate the image.

For reducing the carry-over and also for increasing the recovery of silver, it is desirable that the dry film thickness of the silver halide photosensitive material of the present invention for color photography excluding the support is 25 μm or below. Particularly, the dry film thickness of the color negative film is preferably about 13 to 23 μm, and that of the color paper is preferably about 7 to 12 μm.

The thickness of the film can be reduced by reducing the amount of the gelatin, silver, oil, coupler, etc. The reduction of the amount of gelatin is most preferred. The film thickness can be determined by an ordinary method after leaving the sample to stand at 25° C. at 60 RH % for two weeks.

To improve the stain prevention and image preservation, the degree of swelling of the photographic layers of the silver halide color photographic material used in the invention is preferably 1.5 to 4.0, particularly 1.5 to 3.0. The term "degree of swelling" herein indicates a value obtained by dividing the thickness of the photographic layers after immersing the color photosensitive material in distilled water of 33° C. for 2 minutes by the thickness of the dry photographic layers.

The term "photographic layers" indicate layers composed of at least one photosensitive silver halide emulsion layer laminated with hydrophilic colloid layers, the former layer and the latter layers being water-permeable between each other. The photographic layers do not include a back layer provided on the support on an opposite side to the photographic photosensitive layers. The photographic layers comprise usually two or more layers participating in the formation of a photographic image, namely, a silver halide emulsion layer, intermediate layer, filter layer, antihalation layer and protecting layer.

The degree of swelling can be controlled as described above by any method. For example, it can be controlled by varying the amount and kind of the gelatin and those of the hardener used for the photographic film or by varying the drying conditions and leaving-to-stand conditions after forming the photographic layers. Although gelatin is advantageously used for forming the photographic layers, other hydrophilic colloids are also usable. For example, various synthetic hydrophilic macromolecular substances can be used, such as gelatin derivatives; graft polymers of gelatin and another polymer; proteins such as albumin and casein; cellulose derivatives such as hydroxyethylcellulose, carboxymethylcellulose and cellulose sulfate; saccharide derivatives such as sodium alginate and starch derivatives; and homopolymers or copolymers such as polyvinyl alcohol, partial acetal of polyvinyl alcohol, poly-N-vinylpyrrolidone, polyacrylic acid, polymethacrylic acid, polyacrylamide, polyvinylimidazole and polyvinylpyrazole.

The gelatins usable herein include gelatin treated with lime or an acid, gelatin hydrolyzate and enzymatic decomposition, products of gelatin. The gelatin derivatives are obtained by reacting gelatin with a compound selected from among various acid halides, acid anhydrides, isocyanates, bromoacetic acid, alkanesultones, vinylsulfonamides, maleinimide compounds, polyalkylene oxides and epoxy compounds.

The graft polymers of gelatin usable herein include those obtained by grafting a homopolymer or copolymer of a vinyl monomer such as acrylic acid, methacrylic acid or a derivative thereof, e.g. an ester or amide thereof, acrylonitrile or styrene onto gelatin. Preferred are graft polymers of gelatin with a polymer which is compatible with gelatin to a considerable extent such as a polymer of acrylic acid, methacrylic acid, acrylamide, methacrylamide or hydroxyalkyl methacrylate. Examples of them are given in U.S. Pat. Nos. 2,763,625, 2,831,767, 2,956,884 and so on. Typical synthetic hydrophilic macromolecular substances are described in, for example, West German Patent Application (OLS) No. 2,312,708, U.S. Pat. Nos. 3,620,751 and 3,879,205 and J. P. KOKOKU No. Sho 43-7561.

The hardening agents include, for example, chromium salts (such as chromium alum and chromium acetate), aldehydes (such as formaldehyde, glyoxal and glutaraldehyde), N-methylol compounds (such as dimethylolurea and methyloldimethylhydantoin), dioxane derivatives (such as 2,3-dihydroxydioxane), active vinyl compounds {such as 1,3,5-triacryloyl-hexahydro-s-triazine, bis(vinylsulfonyl)methyl ether and N,N'-methylenebis-[β-(vinylsulfonyl)propionamide]}, active halogen compounds (such as 2,4-dichloro-6-hydroxy-s-triazine), mucohalogenic acids (such as mucochloric acid and mucophenoxychloric acid), isoxazoles, dialdehyde starch and 2-chloro-6-hydroxytriazinylated gelatin. They can be used either singly or in combination of them.

Particularly preferred hardening agents are the aldehydes, active vinyl compounds and active halogen compounds.

The support for the photosensitive material for papers of the present invention may be a white polyester support for display or a support having a white pigment-containing layer formed thereon on the same side as the silver halide emulsion layer. The transmission density of the support is controlled preferably in the range of 0.35 to 0.8 so that the display can be seen with a reflected light or transmitted light.

The photosensitive material of the present invention may be exposed to a visible light or infrared light. The exposing method may be either a low illuminance exposure or a high-illuminance short-time exposure. In the latter, a laser scanning exposing method wherein the exposure time per picture element is shorter than $10^{-4}$ second is preferred.

In the exposure, a band stop filter described in U.S. Pat. No. 4,880,726 is preferably used in order to remarkably improve the color reproducibility by avoiding the optical color mixing.

The processing method of the present invention can be employed for various photosensitive materials such as color negative films, color negative papers, color reversal papers, autopositive papers, color reversal films, negative films for movies, positive films for movies, roentgen films, reprophotographic films such as lith films, and black-and-white negative films. Particularly preferred are color negative films and color negative papers.

The following Examples will further illustrate the present invention, which by no means limit the invention.

EXAMPLE 1

A color negative film, which will be referred to as "sample 101", was prepared by forming layers of the following compositions on a subbed cellulose triacetate film support:

(Compositions of photosensitive layers)

Main materials used for forming the layers are classified as follows:

ExC: cyan coupler

ExM: magenta coupler

ExY: yellow coupler

ExS: sensitizing dye

UV: ultraviolet absorber

HBS: high-boiling organic solvent

H: gelatin hardener

The numerals for the respective components indicate the amount of coating given by g/m$^2$. Those for silver halides are given in terms of silver. Those for sensitizing dyes are given in terms of molar unit per mol of the silver halide contained in the same layer.

(Sample 101)

| | | |
|---|---|---|
| **The first layer (antihalation layer):** | | |
| black colloidal silver | silver | 0.09 |
| gelatin | | 1.60 |
| ExM-1 | | 0.12 |
| ExF-1 | | $2.0 \times 10^{-3}$ |
| solid dispersed dye ExF-2 | | 0.030 |
| solid dispersed dye ExF-3 | | 0.040 |
| HBS-1 | | 0.15 |
| HBS-2 | | 0.02 |
| **The second layer (intermediate layer):** | | |
| silver bromoiodide emulsion M | silver | 0.065 |
| ExC-2 | | 0.04 |
| polyethyl acrylate latex | | 0.20 |
| gelatin | | 1.04 |
| **The third layer (low-speed red-sensitive emulsion layer)** | | |
| silver bromoiodide emulsion A | silver | 0.25 |
| silver bromoiodide emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| gelatin | | 0.87 |
| **The fourth layer (medium-speed red-sensitive emulsion layer)** | | |
| silver bromoiodide emulsion C | silver | 0.70 |
| ExS-1 | | $3.5 \times 10^{-4}$ |

-continued (Sample 101)

| | | |
|---|---|---|
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| gelatin | | 0.75 |
| **The fifth layer (high-speed red-sensitive emulsion layer)** | | |
| silver bromoiodide emulsion D | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| gelatin | | 1.10 |
| **The sixth layer (intermediate layer)** | | |
| Cpd-1 | | 0.090 |
| solid dispersed dye ExF-4 | | 0.030 |
| HBS-1 | | 0.050 |
| polyethyl acrylate latex | | 0.15 |
| gelatin | | 1.10 |
| **The seventh layer (low-speed green-sensitive emulsion layer)** | | |
| silver bromoiodide emulsion E | silver | 0.15 |
| silver bromoiodide emulsion F | silver | 0.10 |
| silver bromoiodide emulsion G | silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| gelatin | | 0.73 |
| **The eighth layer (medium-speed green-sensitive emulsion layer)** | | |
| silver bromoiodide emulsion H | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| gelatin | | 0.80 |
| **The ninth layer (high-speed green-sensitive emulsion layer)** | | |
| silver bromoiodide emulsion I | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| polyethyl acrylate latex | | 0.15 |
| gelatin | | 1.33 |

-continued

| (Sample 101) | | |
|---|---|---|
| The tenth layer (yellow filter layer) | | |
| yellow colloidal silver | silver | 0.015 |
| Cpd-1 | | 0.16 |
| solid dispersed dye ExF-5 | | 0.060 |
| solid dispersed dye ExF-6 | | 0.060 |
| oil-soluble dye ExF-7 | | 0.010 |
| HBS-1 | | 0.60 |
| gelatin | | 0.60 |
| The eleventh layer (low-speed blue-sensitive emulsion layer) | | |
| silver bromoiodide emulsion J | silver | 0.09 |
| silver bromoiodide emulsion K | silver | 0.09 |
| ExS-7 | | $8.6 \times 10^{-4}$ |
| ExS-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| gelatin | | 1.20 |
| The twelfth layer (high-speed blue-sensitive emulsion layer) | | |
| silver bromoiodide emulsion L | silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| gelatin | | 0.70 |
| The thirteenth layer (the first protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| gelatin | | 1.8 |
| The fourteenth layer (the second protective layer) | | |
| silver bromoiodide emulsion M | silver | 0.10 |
| H-1 | | 0.40 |
| B-1 (diameter: 1.7 μm) | | $5.0 \times 10^{-2}$ |
| B-2 (diameter: 1.7 μm) | | 0.15 |
| B-3 | | 0.05 |
| S-1 | | 0.20 |
| gelatin | | 0.70 |

Further, the respective layers suitably contain W-1 to W-3, B-4 to B-6, F-1 to F-17, iron salts, lead salts, gold salts, platinum salts, iridium salts, palladium salts and rhodium salts in order to improve the storability, processability, pressure resistance, mildew-proofing and bacteria-proofing properties, antistatic properties and coating easiness.

TABLE 6

| Emulsion | Average AgI content (%) | Coefficient of variation in AgI content among grains (%) | Average grain diameter (diameter of corresponding sphere) (mμ) |
|---|---|---|---|
| A | 1.7 | 10 | 0.46 |
| B | 3.5 | 15 | 0.57 |
| C | 8.9 | 25 | 0.66 |
| D | 8.9 | 18 | 0.84 |
| E | 1.7 | 10 | 0.46 |
| F | 3.5 | 15 | 0.57 |
| G | 8.8 | 25 | 0.61 |
| H | 8.8 | 25 | 0.61 |
| I | 8.9 | 18 | 0.84 |
| J | 1.7 | 10 | 0.46 |
| K | 8.8 | 18 | 0.64 |
| L | 14.0 | 25 | 1.28 |
| M | 1.0 | — | 0.07 |

TABLE 6-continued

| Emulsion | Coefficient of variation of grain diameter (%) | Diameter of projected plan (diameter of corresponding circle) (μm) | Diameter/thickness ratio |
|---|---|---|---|
| A | 15 | 0.56 | 5.5 |
| B | 20 | 0.78 | 4.0 |
| C | 25 | 0.87 | 5.8 |
| D | 26 | 1.03 | 3.7 |
| E | 15 | 0.56 | 5.5 |
| F | 20 | 0.78 | 4.0 |
| G | 23 | 0.77 | 4.4 |
| H | 23 | 0.77 | 4.4 |
| I | 26 | 1.03 | 3.7 |
| J | 15 | 0.50 | 4.2 |
| K | 23 | 0.85 | 5.2 |
| L | 26 | 1.46 | 3.5 |
| M | 15 | — | 1 |

In Table 6:

(1) The emulsions J to L were reduction-sensitized with thiourea dioxide and thiosulfonic acid in the step of preparation of the grains as described in an Example of J. P. KOKAI No. Hei 2-191938.

(2) The emulsions A to I were sensitized by gold sensitization, sulfur sensitization and selenium sensitization methods in the presence of a spectral sensitizing dye mentioned above for each photosensitive layer and sodium thiocyanate as described in an Example of J. P. KOKAI No. Hei 3-237450.

(3) In the preparation of tabular grains, a low-molecular weight gelatin was used as described in an Example of J. P. KOKAI No. Hei 1-158426.

(4) Dislocation lines as described in J. P. KOKAI No. Hei 3-237450 are obserbed on the tabular grains with a high-voltage electron microscope.

(5) The emulsion L contained double-structure particles each having an internal high-iodine core as described in J. P. KOKAI No. Sho 60-143331.

Preparation of dispersion of organic solid disperse dye:

ExF-2 which will be described below was dispersed as follows: 21.7 ml of water, 3 ml of 5% aqueous solution of sodium p-octylphenoxyethoxyethanesulfonate and 0.5 g of 5% aqueous solution of p-octylphenoxy polyoxyethylene ether (degree of polymerization: 10) were fed into a 700 ml pot mill. 5.0 g of dye ExF-2 and 500 ml of zirconium oxide beads (diameter: 1 mm) were added thereto, and the mixture was milled with a BO type vibration ball mill (a product of Chuo Koki) for 2 hours to obtain a dispersion. Then the dispersion was taken out and added to 8 g of 12.5% aqueous gelatin solution. The beads were removed by filtration to obtain a dispersion of the dye in gelatin. The average grain diameter of the fine dye grains was 0.44 μm.

A solid dispersion of each of ExF-3, ExF-4 and ExF-6 was obtained in the same manner as that described above. The average grain diameters of the fine dye grains were 0.24 μm, 0.45 μm and 0.52 μm, respectively. ExF-5 was dispersed by a microprecipitation dispersion method described in Example 1 in European Patent Application Kokai (EP) No. 549,489 A. The average grain diameter was 0.06 μm.

ExC-1
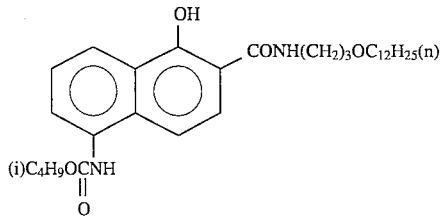
ExC-2
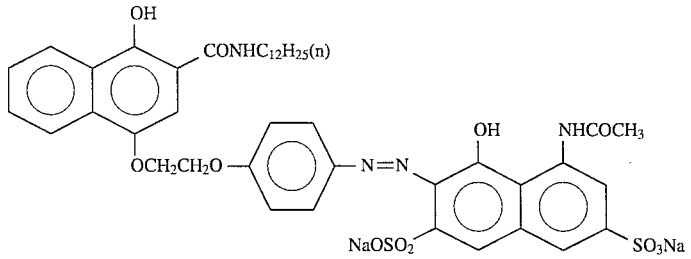
ExC-3
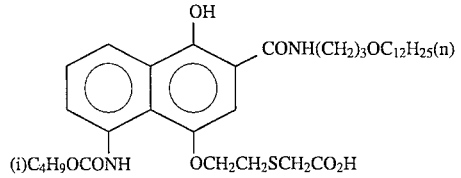
ExC-4
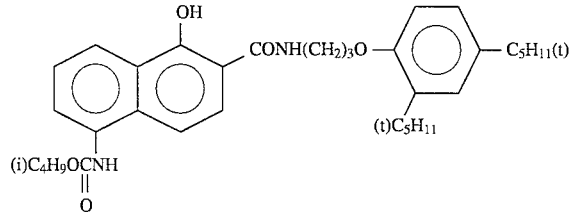
ExC-5
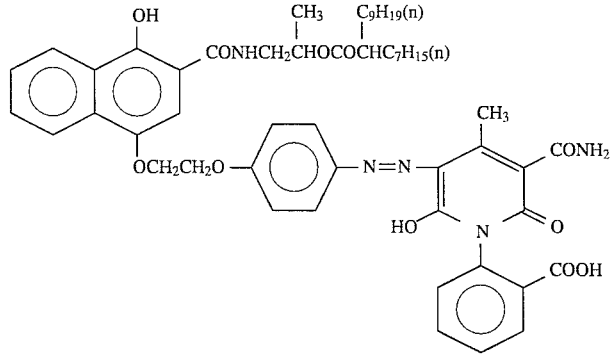
ExC-6
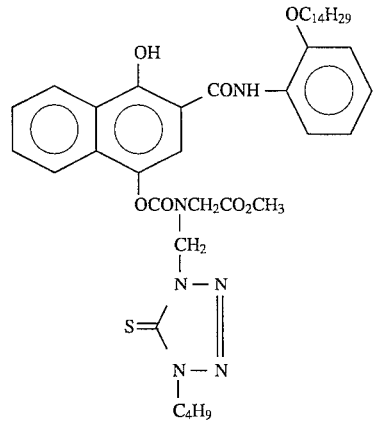

-continued
ExC-7
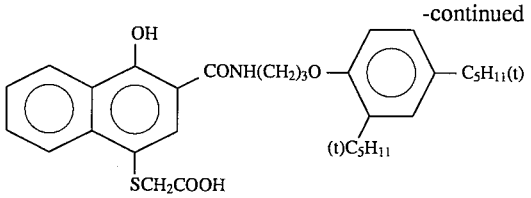
ExC-8
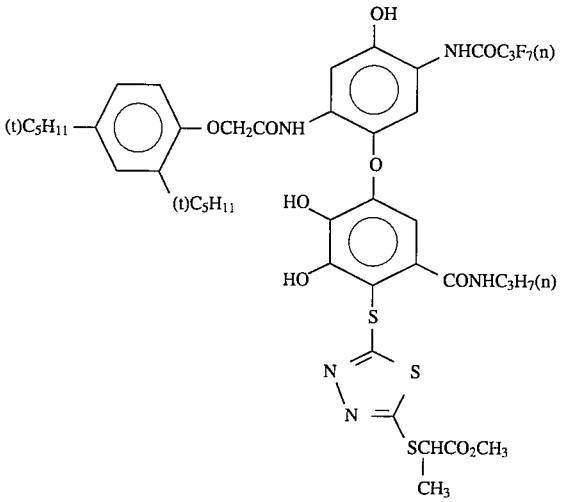
ExM-1
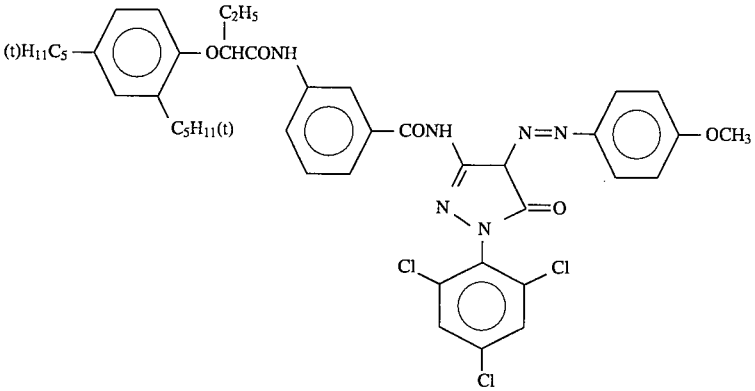
ExM-2
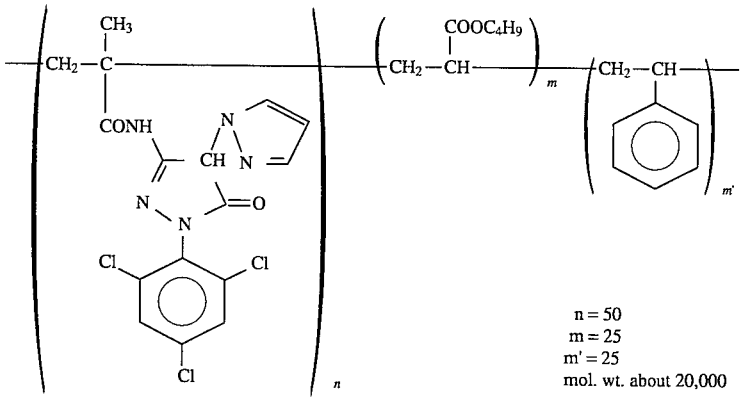
n = 50
m = 25
m' = 25
mol. wt. about 20,000

-continued
ExM-3
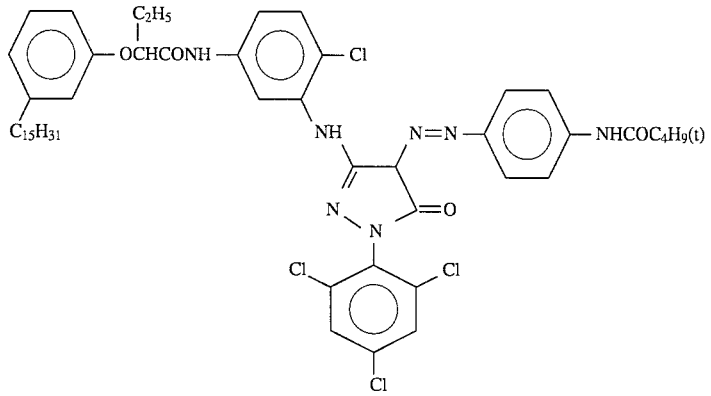
ExM-4
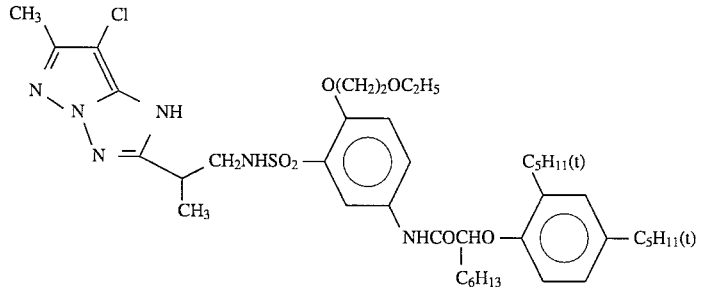
ExM-5
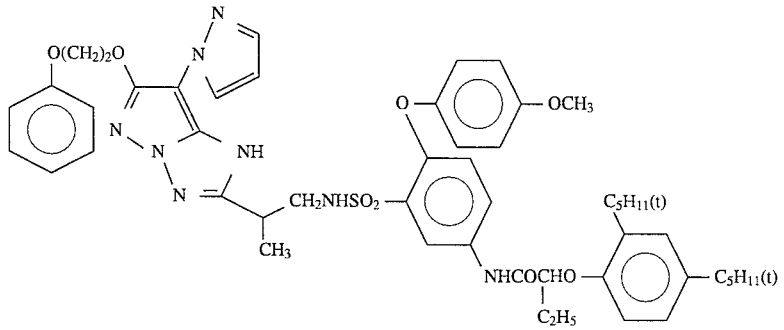
ExY-1
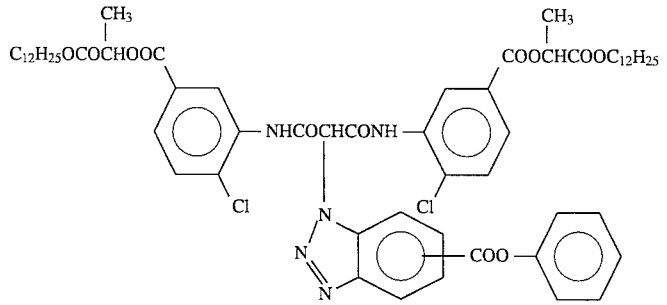
ExY-2
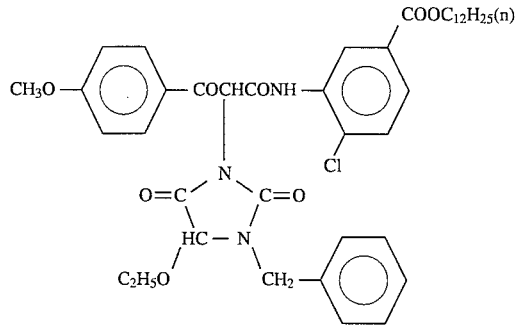

-continued
ExY-3
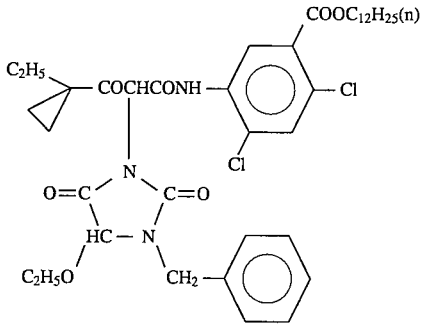
ExY-4
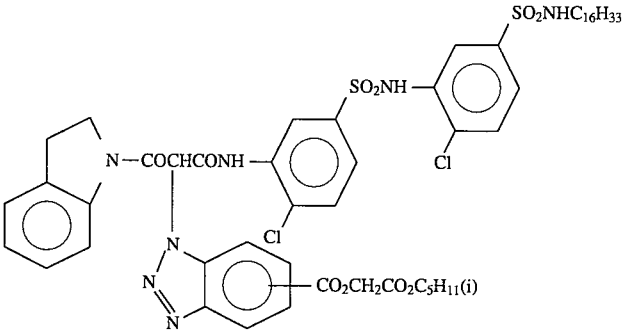
ExY-5
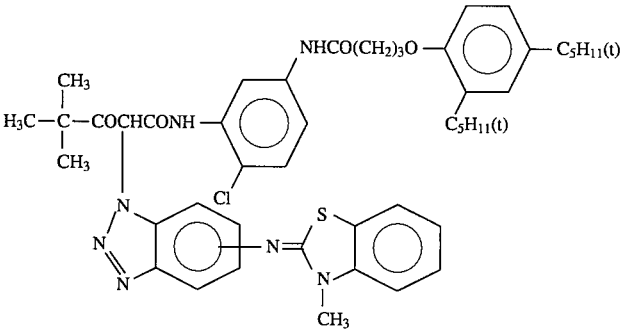
ExF-1
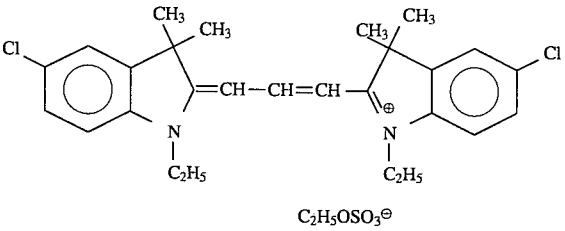
ExF-2
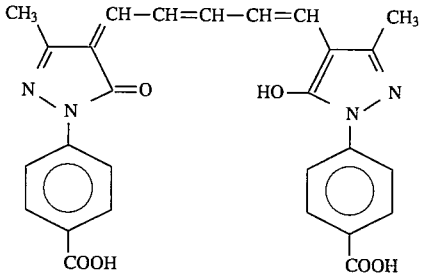
ExF-3
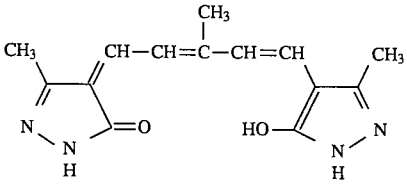

-continued
ExF-4
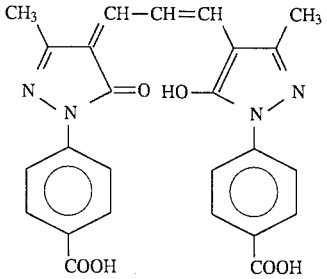
ExF-5
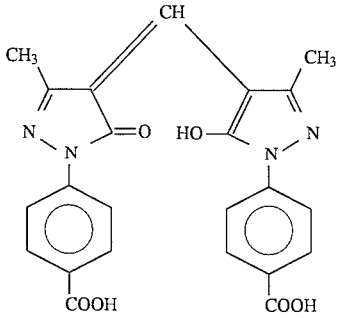
ExF-6
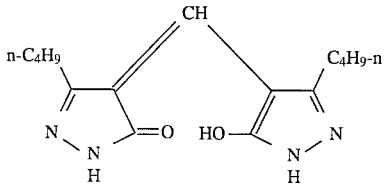
ExF-7
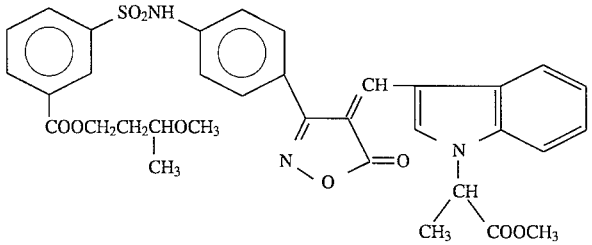
Cpd-1
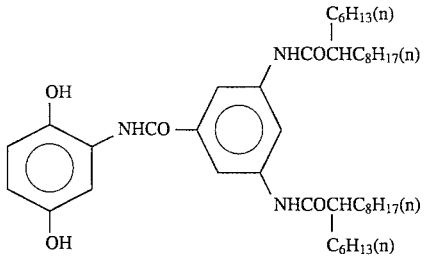
Cpd-2
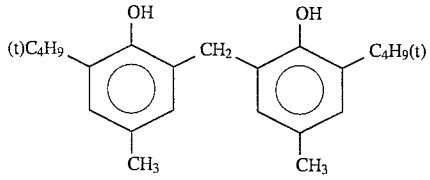
Cpd-3
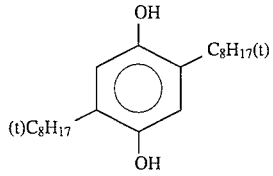

-continued
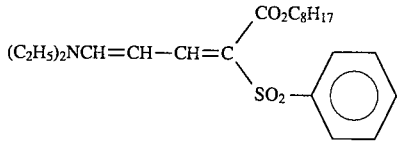
UV-1
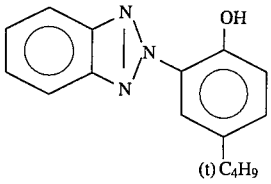
UV-2
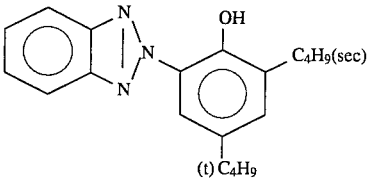
UV-3
tricresyl phosphate HBS-1
di-n-butyl phthalate HBS-2
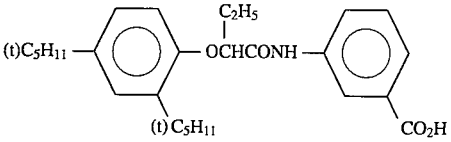
HBS-3
tri(2-ethylhexyl) phosphate HBS-4
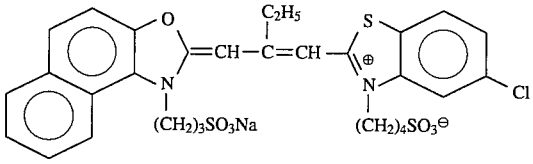
ExS-1
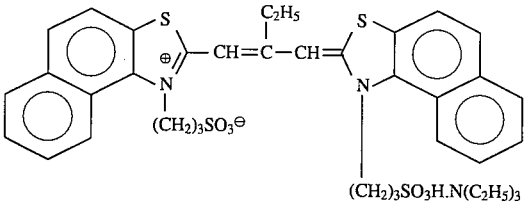
ExS-2
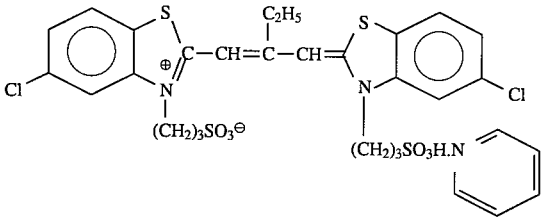
ExS-3
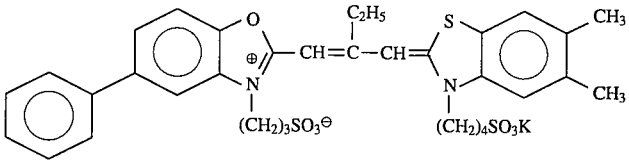
ExS-4

-continued
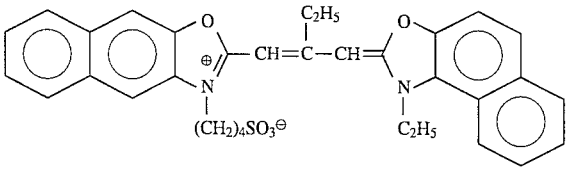
ExS-5
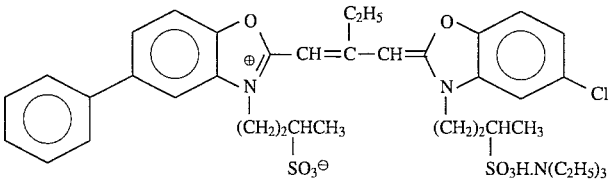
ExS-6
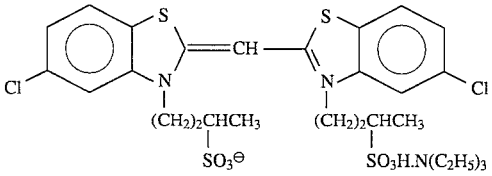
ExS-7
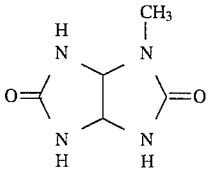
S-1
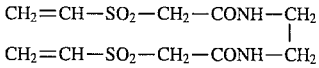
H-1
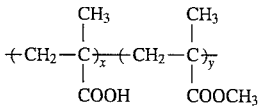
x/y = 10/90
B-1
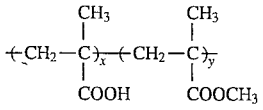
x/y = 40/60
B-2
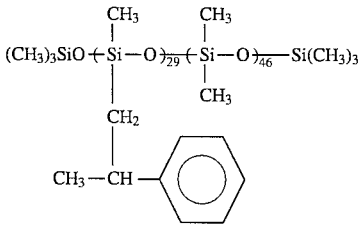
B-3
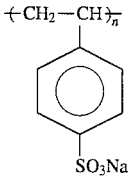
B-4
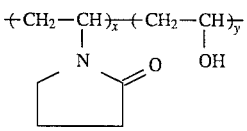
x/y = 70/30
B-5

-continued
B-6
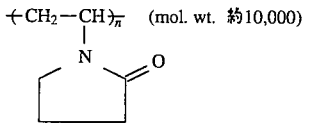
W-1
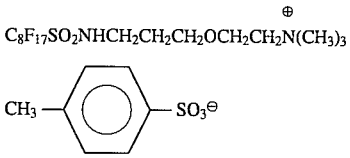
W-2
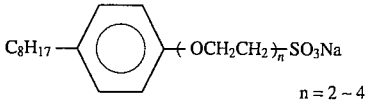
W-3
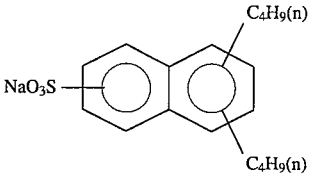
F-1
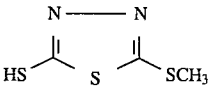
F-2
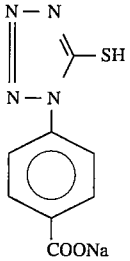
F-3
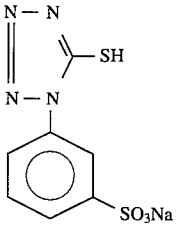
F-4
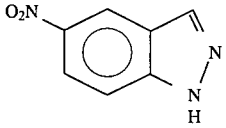
F-5
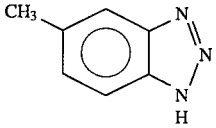
F-6
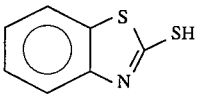

-continued

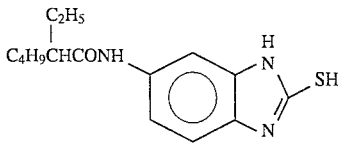

F-7

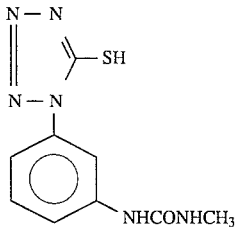

F-8

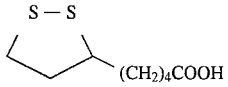

F-9

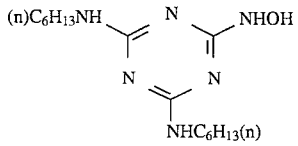

F-10

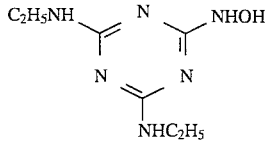

F-11

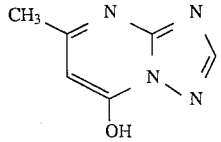

F-12

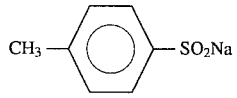

F-13

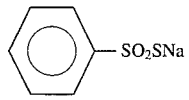

F-14

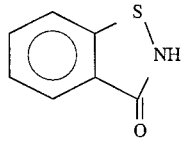

F-15

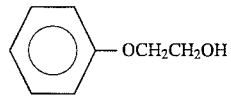

F-16

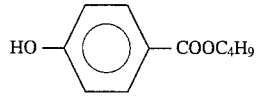

F-17

The color negative film (sample 101) prepared as described above was cut into pieces having a width of 35 mm, and used for taking pictures with a camera. The films were processed at a rate of 33 m/day for 30 days as will be described below.

In the processing, a modified automatic developing machine FP-560B (a product of Fuji Photo Film Co., Ltd.) was used. The automatic developing machine used is shown in FIG. 2.

The processing steps and compositions of the processing solutions are given below.

| (Processing steps) | | | | |
|---|---|---|---|---|
| (Step) | (Process time) | (Process temp.) | (Amount of replenisher)* | (Capacity of tank) |
| Color development | 185 sec | 38.0° C. | 23 ml | 17 l |
| Bleaching | 50 sec | 38.0° C. | 5 ml | 5 l |
| Bleach-fixing | 50 sec | 38.0° C. | — | 5 l |
| Fixing | 50 sec | 38.0° C. | 16 ml | 5 l |
| Washing with water | 30 sec | 38.0° C. | 34 ml | 3.5 l |
| Stabilization (1) | 20 sec | 38.0° C. | — | 3 l |
| Stabilization (2) | 20 sec | 38.0° C. | 20 ml | 3 l |
| Drying | 90 sec | 60° C. | | |

*The amount of replenisher is given per 1.1 m of the photosensitive material having a width of 35 mm (one 24-Ex roll).

The stabilizer flowed countercurrently from (2) to (1). The whole overflow of the washing water was introduced into the fixing bath. As for the replenisher into the bleach-fixing bath, a notch was formed at the top of each of the bleaching tank and fixing tank in the automatic developing machine so that all the overflows formed by feeding the replenisher into the bleaching tank and fixing tank would flow into the bleach-fixing bath. The amount of the developer brought into the bleaching step, that of the bleaching solution into the bleach-fixing step, that of the bleach-fixing solution into the fixing step and that of the fixing solution into the washing step were 2.5 ml, 2.0 ml, 2.0 ml and 2.0 ml, respectively, per 1.1 m of the photosensitive material having 35 mm width. The crossover time was 6 seconds in each step, which was included in the processing time in the preceding step.

The composition of each of the processing liquids was as follows:

| | | Mother liquid (g) | Replenisher (g) |
|---|---|---|---|
| (Color developer) | | | |
| Diethylenetriaminepentaacetic acid | | 2.0 | 2.0 |
| 1-hydroxyethylidene-1,1-diphosphonic acid | | 2.0 | 2.0 |
| Sodium sulfite | | 3.9 | 5.1 |
| Potassium carbonate | | 37.5 | 39.0 |
| Potassium bromide | | 1.4 | 0.4 |
| Potassium iodide | | 1.3 mg | — |
| Hydroxylamine sulfate | | 2.4 | 3.3 |
| 2-Methyl-4-[N-ethyl-N-(β-hydroxyethyl)amino]aniline sulfate | | 4.5 | 6.0 |
| Water | ad | 1.0 l | 1.0 l |
| pH (with potassium hydroxide and sulfuric acid) | | 10.05 | 10.15 |
| (Bleaching solution) | | | |
| Ferric ammonium 1,3-diamino-propanetetraacetate monohydrate | | 130 | 195 |
| Ammonium bromide | | 70 | 105 |
| Ammonium nitrate | | 14 | 21 |
| Hydroxyacetic acid | | 25 | 38 |
| Acetic acid | | 40 | 60 |
| Water | ad | 1.0 l | 1.0 l |
| pH (with ammonia water) | | 4.4 | 4.0 |

(Bleach-fixing mother liquid)

A mixture of the above-described bleaching mother liquid and the following fixing mother liquid in a volume ratio of 15:85. (pH 7.0).

| (Fixing solution) | | Mother liquid (g) | | Replenisher (g) |
|---|---|---|---|---|
| Ammonium sulfite | | 19 | | 57 |
| Aqueous ammonium thiosulfate solution (700 g/l) | | 280 ml | | 40 ml |
| Imidazole | | 15 | | 45 |
| Ethylenediaminetetraacetic acid | | 15 | | 45 |
| Water | ad | 1.0 l | ad | 1.0 l |
| pH (with ammonia water and acetic acid) | | 7.4 | | 7.45 |

(Washing water)

Tap water was passed through a mixed bed column packed with an H-type strongly acidic cation exchange resin (Amberlite IR-120B; a product of Rohm & Haas Co.) and a strongly basic OH-type anion exchange resin (Amberlite IR-400; a product of Rohm & Haas Co.) to reduce calcium and magnesium ion concentration to 3 mg/l or below, and then 20 mg/l of sodium isocyanurate dichloride and 150 mg/l of sodium sulfate were added to the water. pH of the water was in the range of 6.5 to 7.5.

| (Stabilizer) (common to the mother liquid and replenisher) (unit: g) | | |
|---|---|---|
| Sodium p-toluenesulfinate | | 0.03 |
| Polyoxyethylene-p-monononylphenyl ether (average degree of polymerization: 10) | | 0.2 |
| Disodium ethylenediaminetetraacetate | | 0.05 |
| 1,2,4-Triazole | | 1.3 |
| 1,4-Bis(1,2,4-triazol-1-ylmethyl)piperazine | | 0.75 |
| Water | ad | 1.0 l |
| pH | | 8.5 |

In the course of the above-described running tests, the waste liquid was collected by the following two methods:

Method I for collecting waste liquid (ordinary method):

Two 10-liter tanks (A and B) for collecting the waste water were used. The overflows of the silver-free color developer and stabilizing solution were collected in the collecting tank A. The overflow of the silver-containing bleach-fixing solution (including bleaching solution and water used for washing) was collected in the collecting tank B.

The waste liquid in the period of 5 days (21 to 25 days after the initiation) of the running test was taken. The amount of the overflow (OF amount) of the color developer, the total amount of the waste liquid, silver concentration in the waste liquid, pH of the waste liquid and ammonia gas concentration in the waste liquid tank (with an ammonia gas-detecting tube) were determined. The results are given in Table 7.

Method II for recovering waste liquid:

The same procedure as that described above was repeated except that only one 20-liter waste water tank was used and the whole waste liquid in the period of 5 days (26 to 30 days after the initiation of the running test) was taken, and the determination was conducted also in the same manner as that of the method I to obtain the results given in Table 7.

The running test was conducted also in the same manner as that described above except that the amount of each replenisher, composition and processing temperature were changed as described below.

The processing steps and compositions of the processing solutions will be given below.

| (Processing steps) | | | | |
|---|---|---|---|---|
| (Step) | (Process time) | (Process temp.) | (Amount of replenisher)* | (Capacity of tank) |
| Color development | 185 sec | 40.0° C. | 10 ml | 17 l |
| Bleaching | 50 sec | 38.0° C. | 5 ml | 5 l |
| Bleach-fixing | 50 sec | 38.0° C. | — | 5 l |
| Fixing | 50 sec | 38.0° C. | 16 ml | 5 l |
| Stabilization (1) | 30 sec | 38.0° C. | — | 3.5 l |
| Stabilization (2) | 20 sec | 38.0° C. | — | 3 l |
| Stabilization (3) | 20 sec | 38.0° C. | 20 ml | 3 l |
| Drying | 90 sec | 60° C. | | |

*The amount of replenisher is given per 1.1 m of the photosensitive material having a width of 35 mm (one 24-Ex roll).

The stabilizer flowed countercurrently from (3) to (1). The whole overflow of the stabilizing solution was introduced into the fixing bath. As for the replenisher into the bleach-fixing bath, a notch was formed at the top of each of the bleaching tank and fixing tank in the automatic developing machine so that all the overflows formed by feeding the replenisher into the bleaching tank and fixing tank would flow into the bleach-fixing bath. The amount of the developer brought into the bleaching step, that the the bleaching solution into the bleach-fixing step, that of the bleach-fixing solution into the fixing step and that of the fixing solution into the stabilization step were 2.5 ml, 2.0 ml, 2.0 ml and 2.0 ml, respectively, per 1.1 m of the photosensitive material having 35 mm width. The crossover time was 6 seconds in each step, which was included in the processing time in the preceding step.

The composition of each of the processing liquids was as follows:

| | | Mother liquid (g) | Replenisher (g) |
|---|---|---|---|
| (Color developer) | | | |
| Diethylenetriaminepentaacetic acid | | 2.0 | 2.0 |
| 1-hydroxyethylidene-1,1-diphosphonic acid | | 2.0 | 2.0 |
| Sodium sulfite | | 3.9 | 6.1 |
| Potassium carbonate | | 37.5 | 39.0 |
| Potassium bromide | | 2.0 | — |
| Potassium iodide | | 1.8 mg | — |
| Monomethylhydroxylamine | | 3.0 | 5.0 |
| 2-Methyl-4-[N-ethyl-N-(β-hydroxyethyl)amino]aniline sulfate | | 4.5 | 10.0 |
| Water | ad | 1.0 l | 1.0 l |
| pH (with potassium hydroxide and sulfuric acid) | | 10.05 | 10.15 |
| (Bleaching bath) | | | |
| Ferric ammonium 1,3-diamino-propanetetraacetate monohydrate | | 130 | 195 |
| Ammonium bromide | | 70 | 105 |
| Ammonium nitrate | | 14 | 21 |
| Hydroxyacetic acid | | 25 | 38 |
| Acetic acid | | 40 | 60 |
| Water | ad | 1.0 l | 1.0 l |
| pH (with ammonia water) | | 4.4 | 4.0 |

(Bleach-fixing mother liquid)

A mixture of the above-described bleaching mother liquid and the following fixing mother liquid in a volume ratio of 15:85. (pH 6.5).

| (Fixing solution) | | Mother liquid (g) | | Replenisher (g) |
|---|---|---|---|---|
| Ammonium sulfite | | 19 | | 57 |
| Aqueous ammonium thiosulfate solution (700 g/l) | | 300 ml | | 900 ml |
| Imidazole | | 20 | | 60 |
| Ethylenediaminetetraacetic acid | | 15 | | 45 |
| Sodium rhodanide | | 50 | | 80 |
| Water | ad | 1.0 l | ad | 1.0 l |
| pH (with ammonia water and acetic acid) | | 6.8 | | 7.30 |

| (Stabilizer) (common to the mother liquid and replenisher) (unit: g) | | |
|---|---|---|
| Sodium p-toluenesulfinate | | 0.03 |
| Polyoxyethylene-p-monononyl-phenyl ether (average degree of polymerization: 10) | | 0.2 |
| Disodium ethylenediaminetetra-acetate | | 0.05 |
| 1,2,4-Triazole | | 1.3 |
| 1,4-Bis(1,2,4-triazol-1-ylmethyl)-piperazine | | 0.75 |
| 1-Thiazolylbenzimidazole | | 0.050 |
| Water | ad | 1 l |
| pH | | 8.5 |

In the course of the above-described running tests, the waste liquid was collected by the following method:

Method III for collecting waste liquid (present invention): Only one 10-liter waste liquid tank was used for collecting the whole overflows.

The waste liquid in the period of 5 days (26 to 30 days after the initiation of the running test) was taken, and the amount of the overflow (OF amount) of the color developer, the total amount of the waste liquid, silver concentration in the waste liquid and ammonia gas concentration in the waste liquid tank (with an ammonia gas-detecting tube) were determined. The results are given in Table 7.

TABLE 7

| | | | Results | | |
|---|---|---|---|---|---|
| No. | Method for collecting waste liquid | Tank | OF amount of CD (ml/m²) | Total amount of waste liquid (l) | Silver conc. (g/l) |
| 01 | I | A | 520 | 5.75 | 0 |
| | | B | | 8.25 | 4.6 |
| 02 | II | | 520 | 14.0 | 2.6 |
| 03 | III | | 180 | 6.6 | 6.0 |

| | Results | | |
|---|---|---|---|
| No. | pH of waste liquid | Conc. of ammonia gas (ppm) | Remarks |
| 01 | 9.6 | 55 | Comp. Ex. |
| | 7.0 | 150 | |
| 02 | 8.4 | 880 | Comp. Ex. |
| 03 | 6.3 | 80 | Present invention |

Although the ordinary method I for collecting the waste liquid has advantages that the silver concentration in tank B is high, that silver can be selectively recovered from the tank B and that ammonia formed in the tank is only small in amount, it has a disadvantage that two tanks are necessary for the waste liquids.

Although only one recovering tank is used in the method II for collecting the waste liquid, it is yet unsuitable for the practical use, since the concentration of recovered silver is low, pH of the waste liquid is high and ammonia smells strongly.

The method III of the present invention for collecting the waste liquid by using only one recovering tank is excellent, since pH of the waste liquid can be lowered to 6.5 or below particularly by reducing the amount of the overflow of the developer, the smell of ammonia can be remarkably weakened and silver of a high concentration can be recovered.

EXAMPLE 2

The surface of a paper support having the both surfaces laminated with polyethylene was subjected to corona discharge treatment. Then a subbing layer comprising gelatin containing sodium dodecylbenzenesulfonate was formed thereon and further photographic constituent layers were formed thereon to form a multi-layer color printing paper (101) having a laminate structure which will be described below. The coating solutions were prepared as follows:

Preparation of coating solution for forming the first layer:

153.0 g of yellow coupler (ExY), 15.0 g of color image stabilizer, 7.5 g of color image stabilizer (Cpd-2) and 16.0 g of color image stabilizer (Cpd-3) were dissolved in 25 g of solvent (Solv-1), 25 g of solvent (Solv-2) and 180 ml of ethyl acetate. The resultant solution was emulsion-dispersed in 1000 g of 10% aqueous gelatin solution containing 60 ml of 10% sodium dodecylbenzenesulfonate and 10 g of citric acid to obtain an emulsified dispersion A. Separately, a silver chlorobromide emulsion A [a mixture of a large grain size emulsion A having an average grain size of 0.88 μm and a small grain size emulsion A having an average grain size of 0.70 μm in a molar ratio of 3:7 (in terms of Ag)] was prepared. The coefficient of variation of the grain size distribution was 0.08 and 0.10 in both emulsions, respectively. In both emulsions, 0.3 molar % of silver bromide was locally contained in a part of the grain surface mainly comprising silver chloride. Blue-sensitive sensitizing dyes A and B were added to the large-size grain emulsion A each in an amount of $2.0\times10^{-4}$ mol per mol of silver and they were added to the small-size grain emulsion A in an amount of $2.5\times10^{-4}$ mol. The chemical aging of the emulsion was conducted by adding a sulfur sensitizer and gold sensitizer. The emulsifed dispersion A prepared as described above was mixed with this silver chlorobromide emulsion A to obtain a solution to be used for forming the first layer, which had a composition which will be described below. The amount of the emulsion used for coating is given in terms of silver.

Coating solutions for forming the second to the seventh layers were prepared in the same manner as that of the preparation of the coating solution for forming the first layer. Sodium salt of 1-hydroxy-3,5-dichloro-s-triazine was used as the hardener for gelatin in the respective layers.

Cpd-14 and Cpd-15 were incorporated into the respective layers so that the total amounts of them would be 25.0 mg/m$^2$ and 50.0 mg/m$^2$, respectively.

Spectral sensitizing dyes listed below were incorporated into the silver chlorobromide emulsions for forming the photosensitive emulsion layers.

Blue-sensitive emulsion layer:

sensitizing dye A

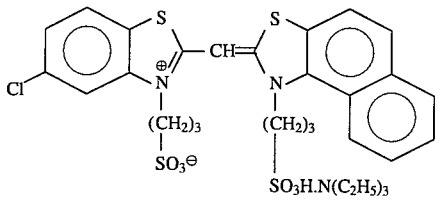

and
sensitizing dye B

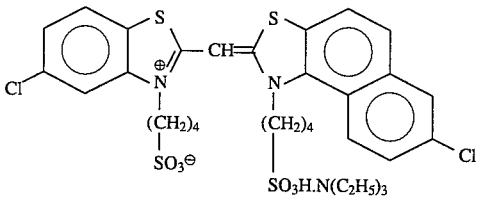

(in amounts of $2.0\times10^{-4}$ mol and $2.5\times10^{-4}$ mol, per mol of the silver halide, for the large-size grain emulsion and small-size grain emulsion, respectively).

-continued

Green-sensitive emulsion layer:

sensitizing dye C

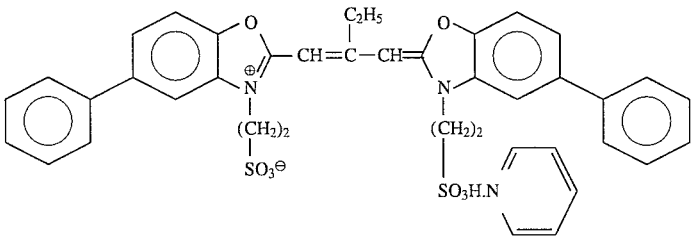

(in amounts of $4.0 \times 10^{-4}$ mol and $5.6 \times 10^{-4}$ mol, per mol of the silver halide, for the large-size grain emulsion and small-size grain emulsion, respectively), and sensitizing dye D

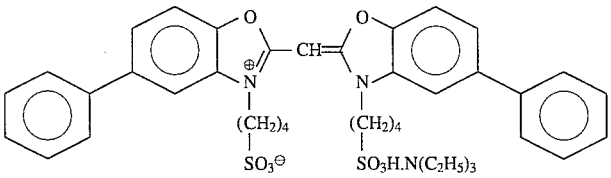

(in amounts of $7.0 \times 10^{-5}$ mol and $1.0 \times 10^{-4}$ mol, per mol of the silver halide, for the large-size grain emulsion and small-size grain emulsion, respectively).

Red-sensitive emulsion layer:

sensitizing dye E

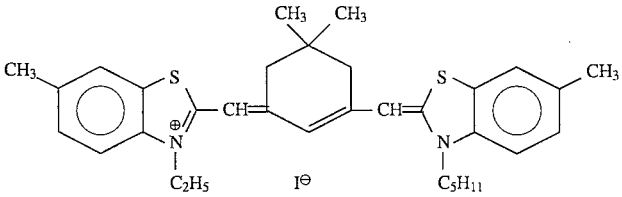

(in amounts of $0.9 \times 10^{-4}$ mol and $1.1 \times 10^{-4}$ mol, per mol of the silver halide, for the large-size grain emulsion and small-size grain emulsion, respectively).

In addition, the following compound was added in an amount of $2.6 \times 10^{-3}$ mol per mol of the silver halide.

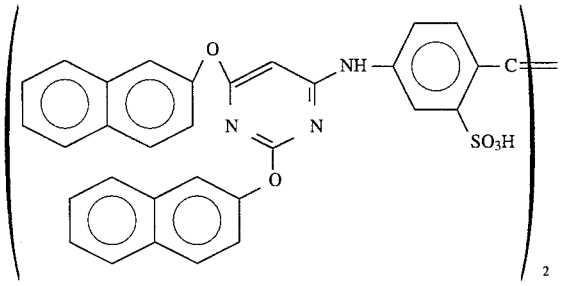

1-(5-Methylureidophenyl)-5-mercaptotetrazole was added to the blue-sensitive emulsion layer, green-sensitive emulsion layer and red-sensitive emulsion layer in amounts of $8.5 \times 10^{-5}$ mol, $7.7 \times 10^{-4}$ mol and $2.5 \times 10^{-4}$ mol, respectively, per mol of the silver halide.

4-Hydroxy-6-methyl-1,3,3a,7-tetrazaindene was added to the blue-sensitive emulsion layer and green-sensitive emulsion layer in amounts of $1 \times 10^{-6}$ mol and $2 \times 10^{-6}$ mol, respectively, per mol of the silver halide.

Further, the following dye was incorporated into the emulsion layer for prevention of irradation (the numeral in the parentheses being the amount).

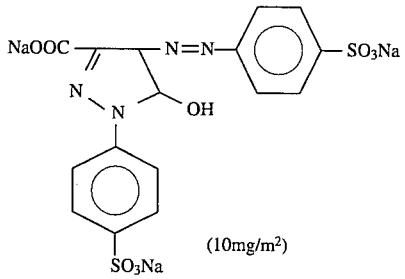
(10mg/m²)
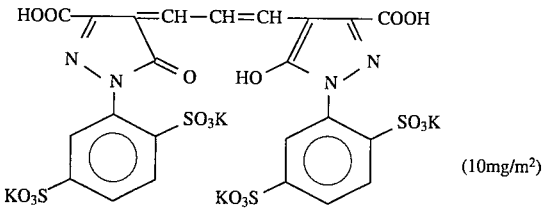
(10mg/m²)
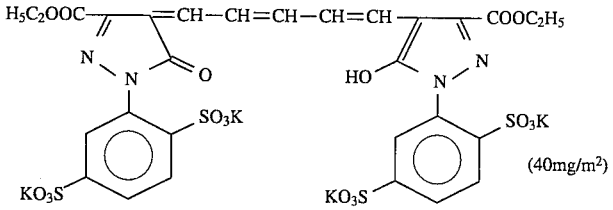
(40mg/m²)
and
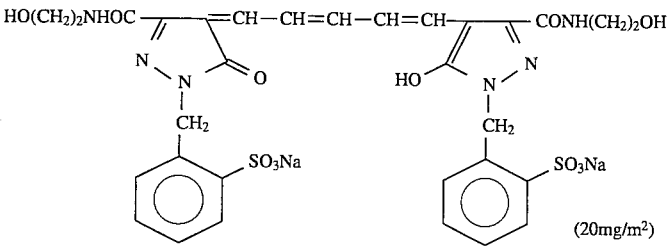
(20mg/m²)
(Layer constitution)
The composition of each layer will be given below. The numerals indicating the amount of the coating solution are given by g/m². The amount of the silver halide emulsion is given in terms of silver.

| | |
|---|---|
| Support: | |
| Polyethylene-laminated paper [containing a white pigment ($TiO_2$) and bluing dye (ultramarine) in the polyethylene on the first layer side] | |
| The first layer (blue-sensitive emulsion layer) | |
| The above-described silver chlorobromide emulsion A | 0.27 |
| Gelatin | 1.36 |
| Yellow coupler (ExY) | 0.79 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.13 |
| Solvent (Solv-2) | 0.13 |
| The second layer (color-mixing inhibiting layer) | |
| Gelatin | 1.00 |
| Color-mixing inhibitor (Cpd-4) | 0.06 |
| Solvent (Solv-2) | 0.25 |
| Solvent (Solv-3) | 0.25 |
| Solvent (Solv-7) | 0.03 |
| The third layer (green-sensitive emulsion layer) | |
| Silver chlorobromide emulsion [cubic; a mixture of large size grain emulsion B having average grain size of 0.55 μm and small size grain emulsion B having average grain size of 0.39 μm in a molar ratio of 1:3 (in terms of Ag); the coefficient of variation of the grain size distribution being 0.10 and 0.08, respectively; and 0.8 molar % of AgBr being localized in a part of the grain surface mainly comprising silver chloride in both emulsions] | 0.13 |
| Gelatin | 1.45 |
| Magenta coupler (ExM) | 0.16 |
| Color image stabilizer (Cpd-2) | 0.03 |
| Color image stabilizer (Cpd-5) | 0.15 |
| Color image stabilizer (Cpd-6) | 0.01 |
| Color image stabilizer (Cpd-7) | 0.01 |
| Color image stabilizer (Cpd-8) | 0.08 |
| Solvent (Solv-3) | 0.50 |
| Solvent (Solv-4) | 0.15 |
| Solvent (Solv-5) | 0.15 |
| The fourth layer (color-mixing inhibiting layer) | |
| Gelatin | 0.70 |
| Color-mixing inhibitor (Cpd-4) | 0.04 |
| Solvent (Solv-2) | 0.18 |
| Solvent (Solv-3) | 0.18 |
| Solvent (Solv-7) | 0.02 |
| The fifth layer (red-sensitive emulsion layer) | |
| Silver chlorobromide emulsion [cubic; a mixture of large-size grain emulsion C having average grain size of 0.50 μm and small-size grain emulsion C having average grain size of 0.41 μm in a molar ratio of 1:4 (in terms of Ag); the coefficient of variation of the grain size distribution being 0.09 and 0.11, respectively; and 0.8 molar % of AgBr being localized in a part of the grain surface mainly comprising silver chloride in both emulsions] | 0.20 |
| Gelatin | 0.85 |
| Cyan coupler (ExC) | 0.33 |
| Ultraviolet absorber (UV-2) | 0.18 |
| Color image stabilizer (Cpd-1) | 0.03 |
| Color image stabilizer (Cpd-6) | 0.01 |
| Color image stabilizer (Cpd-8) | 0.01 |
| Color image stabilizer (Cpd-9) | 0.01 |
| Color image stabilizer (Cpd-10) | 0.01 |
| Color image stabilizer (Cpd-11) | 0.01 |
| Solvent (Solv-1) | 0.01 |
| Solvent (Solv-6) | 0.22 |
| The sixth layer (ultraviolet absorbing layer) | |
| Gelatin | 0.55 |
| Ultraviolet absorber (UV-1) | 0.38 |
| Color image stabilizer (Cpd-5) | 0.02 |
| Color image stabilizer (Cpd-12) | 0.15 |
| The seventh layer (protective layer) | |
| Gelatin | 1.13 |
| Acryl-modified polyvinyl alcohol copolymer (degree of modification: 17%) | 0.05 |
| Liquid paraffin | 0.02 |
| Surfactant (Cpd-13) | 0.01 |

-continued
(ExY) yellow coupler:
a mixture of the following compounds in a molar ratio of 1:1:
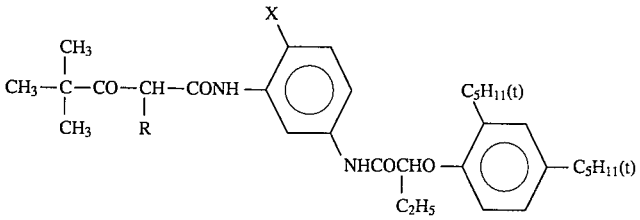
R = 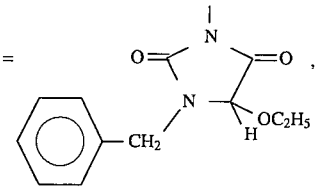 , X = Cl and R = 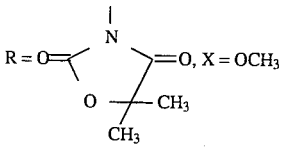 , X = $OCH_3$
(ExM) magenta coupler
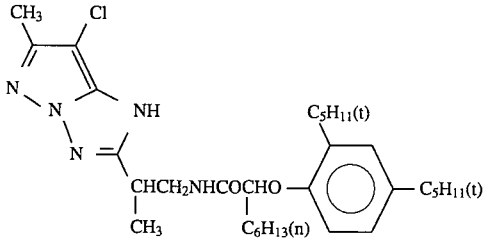
(ExC) cyan coupler:
mixture of the following compounds in a molar ratio of 3:7:
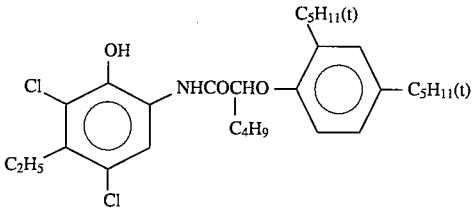
and 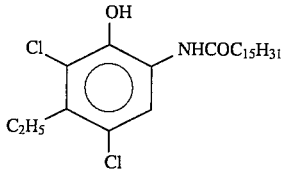
(Cpd-1) color image stabilizer
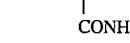 average molecular weight: 60,000
(Cpd-2) color image stabilizer
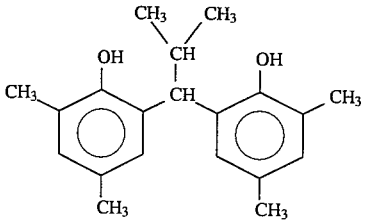

-continued
(Cpd-3) color image stabilizer
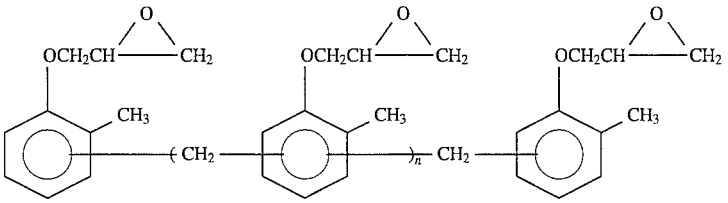
n = 7~8 on average
(Cpd-4) color-mixing inhibitor
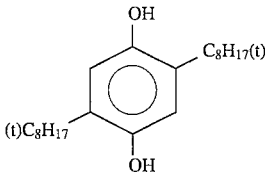
(Cpd-5) color image stabilizer
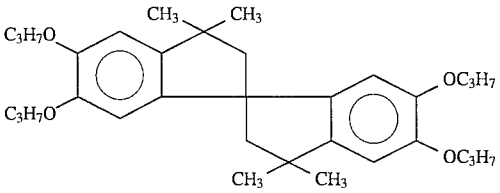
(Cpd-6)
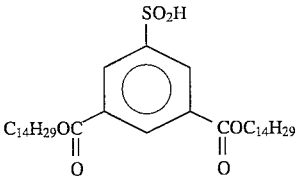
(Cpd-7)
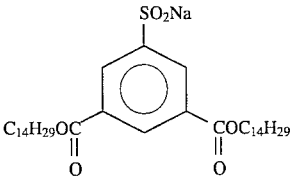
(Cpd-8) color image stabilizer
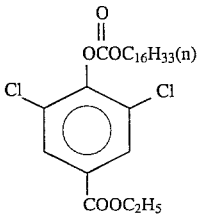
(Cpd-9) color image stabilizer
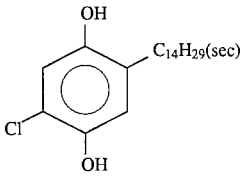
(Cpd-10) color image stabilizer
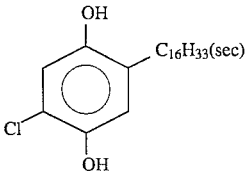
(Cpd-11)
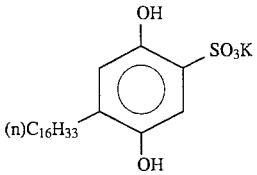
(Cpd-12)
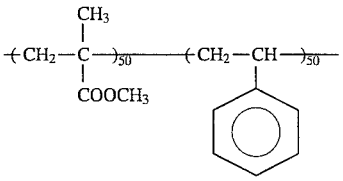
average molecular weight: 60,000
(Cpd-13)
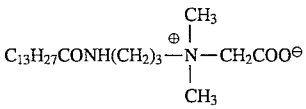

-continued
(Cpd-14) antiseptic
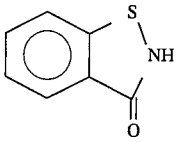
(Cpd-15) antiseptic
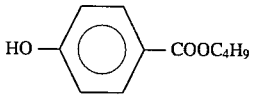
(UV-1) ultraviolet absorber:
mixture of the following compounds in a weight ratio of 1:5:10:5
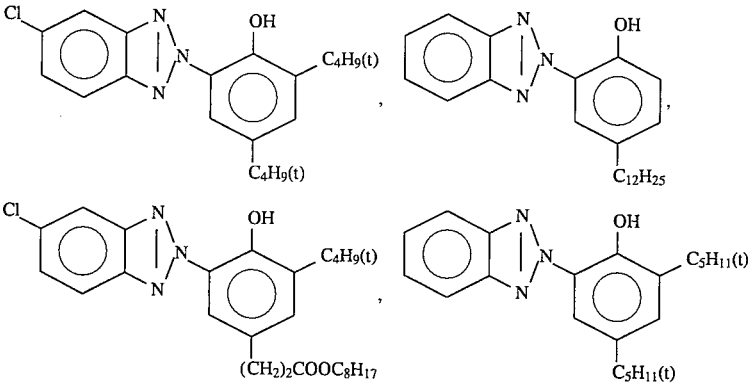
(UV-2) ultraviolet absorber:
mixture of the following compounds in a weight ratio of 1:2:2
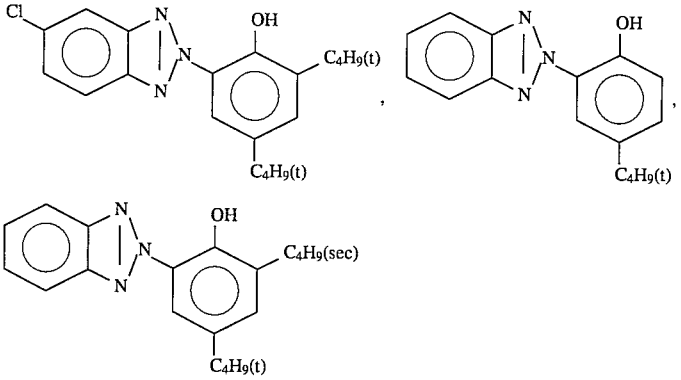
(Solv-1) solvent
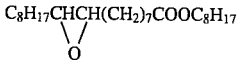
(Solv-2) solvent
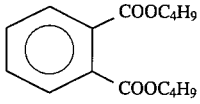
(Solv-3) solvent
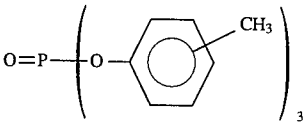
(SOlv-4) solvent)
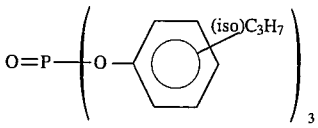
(Solv-5) solvent
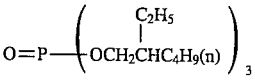

-continued (Solv-6) solvent

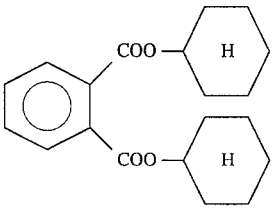

(Solv-7) solvent

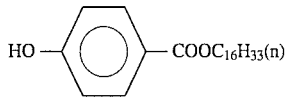

The color paper (sample 201) thus obtained was cut to obtain a roll having a width of 127 mm. After the image-wise exposure with a printer processor PP 1820V (a product of Fuji Photo Film Co., Ltd.), the running test was conducted by a method comprising the following processing steps to process 23 $m^2$ of the paper a day until the total quantity of the replenisher had become twice as much as the capacity of the color development tank.

| Processing step | Temp. | Time | Amount of replenisher* |
|---|---|---|---|
| Color development | 38.5° C. | 45 sec | 73 ml |
| Bleach-fixing | 35° C. | 45 sec | 60 ml |
| Rinse (1) | 35° C. | 20 sec | — |
| Rinse (2) | 35° C. | 20 sec | — |
| Rinse (3) | 35° C. | 20 sec | — |
| Rinse (4) | 35° C. | 30 sec | 240 ml |
| Drying | 80° C. | 60 sec | |

*The quantity of the replenisher was given per $m^2$ of the photosensitive material.
**In addition to 60 ml mentioned above, 120 ml was introduded from rinse (1) per $m^2$ of the photosensitive material.
(The rinsing was conducted by counter-current method from (4) to (1) with three tanks.)

The amount of the carry-over was 40 ml per $m^2$ of the photosensitive material in each bath.

The composition of each of the processing liquids was as follows:

| | | Mother liquor | Replenisher |
|---|---|---|---|
| [Color developer] | | | |
| Water | | 800 ml | 800 ml |
| Ethylenediaminetetraacetic acid | | 3.0 g | 3.0 g |
| Disodium 4,5-dihydroxybenzene-1,3-disulfonate | | 0.5 g | 0.5 g |
| Triethanolamine | | 12.0 g | 12.0 g |
| Potassium chloride | | 6.5 g | — |
| Potassium bromide | | 0.03 g | — |
| Potassium carbonate | | 27.0 g | 27.0 g |
| Fluorescent brightener (WHITEX 4; a product of Sumitomo Chemical Co., Ltd.) | | 1.0 g | 3.0 g |
| Sodium sulfite | | 0.1 g | 0.1 g |
| Disodium-N,N-bis(sulfonatoethyl)-hydroxylamine | | 5.0 g | 10.0 g |
| Sodium triisopropylnaphthalene(β)-sulfonate | | 0.1 g | 0.1 g |
| N-Ethyl-N-(β-methanesulfonamido-ethyl)-3-methyl-4-aminoaniline 3/2sulfate monohydrate | | 5.0 g | 11.5 g |
| Water | ad | 1000 ml | 1000 ml |
| pH (with potassium hydroxide and sulfuric acid) at 25° C.) | | 10.00 | 11.00 |
| [Bleach-fixing solution] | | | |
| Water | | 600 ml | 150 ml |
| Ethylenediaminetetraacetic acid | | 3.0 g | 3.0 g |

-continued

| | | | |
|---|---|---|---|
| Disodium 4,5-dihydroxybenzene-1,3-disulfonate | | 0.5 g | 0.5 g |
| Triethanolamine | | 12.0 g | 12.0 g |
| Potassium chloride | | 10.0 g | — |
| Potassium bromide | | 0.40 g | — |
| Potassium carbonate | | 27.0 g | 27.0 g |
| Fluorescent brightener (WHITEX 4; a product of Sumitomo Chemical Co., Ltd.) | | 1.0 g | 4.0 g |
| Sodium sulfite | | 0.1 g | 0.1 g |
| Disodium-N,N-bis(sulfonatoethyl)-hydroxylamine | | 5.0 g | 15.0 g |
| Sodium triisopropylnaphthalene(β)-sulfonate | | 0.1 g | 0.1 g |
| N-Ethyl-N-(β-methanesulfonamido-ethyl)-3-methyl-4-aminoaniline 3/2sulfate monohydrate | | 5.0 g | 15.0 g |
| Water | ad | 1000 ml | 1000 ml |
| pH (with potassium hydroxide and sulfuric acid at 25° C.) | | 10.00 | 11.80 |
| [Bleach-fixing solution] | | | |
| Water | | 600 ml | 150 ml |
| Ammonium thiosulfate (750 g/l) | | 93 ml | 300 ml |
| Ammonium sulfite | | 40 g | 130 g |
| Ferric ammonium ethylenediamine-tetraacetate | | 55 g | 155 g |
| Ethylenediaminetetraacetic acid | | 5 g | 12.5 g |
| Nitric acid (67%) | | 30 g | 75 g |
| Water | ad | 1000 ml | 1000 ml |
| pH (with acetic acid and ammonia water at 25° C.) | | 5.8 | 5.3 |

(Rinsing water) (common to mother liquid and replenisher)

| | |
|---|---|
| Sodium chlorinated isocyanurate | 0.02 g |
| Deionized water (conductivity: 5 μs/cm or below) | 1000 ml |
| pH | 6.5 |

In the course of the above-described running test, the waste liquid was recovered by the following method:

Method VIII for recovering waste liquid (present invention):

One 10-liter waste liquid tank was used. The pipes were arranged so that all the overflows could be collected. The waste liquid formed after one day was collected, and the amount of the overflow (OF amount) of the color developer, the total amount of the waste liquid, silver concentration in the waste liquid, pH of the waste liquid and ammonia gas concentration in the waste liquid tank were determined. The results are given in Table 8.

The waste liquid was collected in the same manner as that of the above-described collecting method VIII except that the rinse (4) was provided with RC30 to control the rinse replenisher at 120 ml/$m^2$. This method will be referred to as "method IX for collecting waste liquid". The results are given in Table 8.

TABLE 8

| No. | Method for recovering waste liquid | Tank | Results: OF amount of CD (ml/m²) | Total amount of waste liquid (l) | Silver conc. (g/l) |
|---|---|---|---|---|---|
| 21 | IV | A | 30 | 690 | 0 |
| | | B | | 6560 | 1.9 |
| 22 | V | | 30 | 7250 | 1.6 |
| 23 | VI | A | 30 | 690 | 0 |
| | | B | | 3790 | 3.0 |
| 24 | VII | | 30 | 4480 | 2.6 |
| 25 | VIII | | 3 | 6170 | 1.9 |
| 26 | IX | | 3 | 3400 | 3.4 |

| No. | Results: pH of waste liquid | Conc. of ammonia gas (ppm) | Remarks |
|---|---|---|---|
| 21 | 9.6 | 50 | Comp. Ex. |
| | 6.9 | 120 | |
| 22 | 7.9 | 560 | Comp. Ex. |
| 23 | 6.3 | 0 | Comp. Ex. |
| | 6.8 | 110 | |
| 24 | 8.1 | 760 | Comp. Ex. |
| 25 | 6.3 | 80 | Present invention |
| 26 | 6.2 | 70 | Present invention |

It is apparent from Table 8 that the methods IV and VI for collecting the waste liquid have a disadvantage that two waste liquid tanks are necessitated, though it is possible to use only the tank B for recovering silver and ammonia gas is formed in only a small amount.

When these methods IV and VI are modified to that only one tank is used for collecting the waste liquid (collecting methods V and VII), pH of the waste liquid is elevated and ammonia gas is seriously formed unfavorably.

In the waste liquid-collecting methods VIII and IX wherein the developer replenisher is reduced in quantity, a high concentration of silver can be recovered and ammonia gas is formed in only a small amount, though only one tank is used for collecting the waste liquid. Thus, these methods are excellent.

EXAMPLE 3

The color negative film sample 101 obtained in Example 1 and color paper sample 201 obtained in Example 2 were subjected to the imagewise exposure and then to the running test as will be described below. The processing machine was experimentally produced so that the color development of the film and the paper was conducted in separate baths and subsequent steps could be conducted in common baths.

The processing rates of the negative film and the paper were 11 m²/day and 8 m²/day, respectively. The running test was conducted until the total quantity of the replenisher had become twice as much as the capacity of the color development tank.

| Processing step | Temperature: Negative | Temperature: Paper | Time: Negative | Time: Paper | Replenisher (ml)*: Negative | Replenisher (ml)*: Paper |
|---|---|---|---|---|---|---|
| Color development (1) | 40° C. | — | 3'15" | — | 200 | — |
| Color development (2) | | 40° C. | — | 45" | — | 50 |
| Bleach-fixing | 38° C. | 38° C. | 4'00" | 45" | 520 | 50 |
| Stabilization (1)** | 38° C. | 38° C. | 20" | 20" | — | — |
| Stabilization (2) | 38° C. | 38° C. | 20" | 20" | — | — |
| Stabilization (3) | 38° C. | 38° C. | 20" | 20" | 520 | 200 |
| Drying | 60° C. | 70° C. | 60" | 60" | | |

*The quantity of the replenisher was given per m² of the photosensitive material.
**The rinsing was conducted by counter-current method from (3) to (1) with three tanks. The amount is given per m².

In each bath, the amount of the carry-over per m² of the photosensitive material was 60 ml in processing the color negative film and 40 ml in processing the color paper.

The composition of each of the processing liquids was as follows:

| [Color developer (1)] | | Mother liquor (g) | Replenisher (g) |
|---|---|---|---|
| Diethylenetriaminepentaacetic acid | | 2.0 | 2.0 |
| 1-Hydroxyethylidene-1,1-diphosphonic acid | | 2.0 | 2.0 |
| Sodium sulfite | | 3.9 | 6.1 |
| Potassium carbonate | | 37.5 | 39.0 |
| Potassium bromide | | 2.0 | — |
| Potassium iodide | | 2.0 mg | — |
| Hydroxylamine sulfate | | 2.4 | 4.0 |
| 2-Methyl-4-[N-ethyl-N-(β-hydroxyethyl)amino]aniline sulfate | | 4.5 | 9.0 |
| Water | ad | 1.0 l | 1.0 l |
| pH (with potassium hydroxide and sulfuric acid) | | 10.05 | 10.25 |

| [Color developer (2)] | | Mother liquor | Replenisher |
|---|---|---|---|
| Water | | 800 ml | 800 ml |
| Ethylenediaminetetraacetic acid | | 3.0 g | 3.0 g |
| Disodium 4,5-dihydroxybenzene-1,3-disulfonate | | 0.5 g | 0.5 g |
| Triethanolamine | | 12.0 g | 12.0 g |
| Potassium chloride | | 11.5 g | — |
| Potassium bromide | | 0.03 g | — |
| Potassium carbonate | | 27.0 g | 27.0 g |
| Fluorescent brightener (WHITEX 4; a product of Sumitomo Chemical Co., Ltd.) | | 1.0 g | 3.0 g |
| Sodium sulfite | | 0.1 g | 0.1 g |
| Disodium-N,N-bis(sulfonatoethyl)-hydroxylamine | | 5.0 g | 12.0 g |
| Sodium triisopropylnaphthalene(β)-sulfonate | | 0.1 g | 0.1 g |
| N-Ethyl-N-(β-methanesulfonamidoethyl)-3-methyl-4-aminoaniline 3/2sulfate monohydrate | | 5.0 g | 15.0 g |
| Water | ad | 1000 ml | 1000 ml |
| pH (with potassium hydroxide and sulfuric acid at 25° C.) | | 10.00 | 11.20 |

| [Bleach-fixing solution] | Mother liquor (g) | Replenisher (g) |
|---|---|---|
| Ferric ammonium 1,2-cyclohexanediaminetetraacetate monohydrate | 130 | 195 |
| Ammonium sulfite | 19 | 57 |
| Aqueous ammonium thiosulfate solution (700 g/l) | 200 ml | 400 ml |

-continued

| | | | |
|---|---|---|---|
| Imidazole | | 15 | 45 |
| Ethylenediaminetetraacetic acid | | 5 | 5 |
| Water | ad | 1.0 l | 1.0 l |
| pH (with ammonia water and acetic acid) | | 6.0 | 5.45 |

(Stabilizer) (common to mother liquid and replenisher) (unit: g)

| | |
|---|---|
| Sodium p-toluenesulfinate | 0.03 |
| Polyoxyethylene p-monononylphenyl ether (average degree of polymerization: 10) | 0.2 |
| Disodium ethylenediaminetetraacetate | 0.05 |
| pH | 7.0 |

In the course of the above-described running test, the waste liquid was collected by the following two methods:

Method X for collecting waste liquid (ordinary method):

Two 10-liter waste liquid tanks (A and B) were used. The overflow of the developer free from silver was collected in the collecting tank A. The overflows of the silver-containing bleach-fixing solution and stabilizer were collected in the collecting tank B.

The waste liquid formed in one day in the running test was collected, and the amount of the overflow (OF amount) of the color developer, the total amount of the waste liquid, silver concentration in the waste liquid, pH of the waste liquid and ammonia gas concentration in the waste liquid tank (with an ammonia gas-detecting pipe) were determined. The results are given in Table 9.

Method XI for collecting waste liquid (present invention):

The waste liquid was collected in the same manner as that of the above-described recovering method X except that only one 20-liter waste liquid tank was used to collect the whole waste liquid formed in one day in the running test. The results are given in Table 9.

TABLE 9

| No. | Method for collecting waste liquid | Tank | Results: OF amount of CD ($ml/m^2$) | Total amount of waste liquid (l) | Silver conc. (g/l) |
|---|---|---|---|---|---|
| 31 | X | A | Negative: 140 | 0.21 | 0 |
| | | B | Paper: 10 | 3.00 | 4.0 |
| 32 | XI | | Negative: 140<br>Paper: 10 | 3.20 | 3.8 |

| No. | Results: pH of waste liquid | Conc. of ammonia gas (ppm) | Remarks |
|---|---|---|---|
| 31 | 10.1 | 50 | Comp. Ex. |
| | 6.3 | 60 | |
| 32 | 6.5 | 70 | Present invention |

It is apparent from Table 9 that although both the waste liquids formed in processing the color negative film and also in processing the color paper were collected in one tank, no ammonia smell was given off and the collected liquid had a high silver concentration. Thus, the method of the present invention for collecting the waste liquid is excellent.

The advantages of the present invention are, therefore, as follows: the silver-recovery efficiency is not reduced and no ammonia smell was given off.

The processing machine can be reduced in size and the cost thereof can be reduced.

What is claimed is:

1. A processing apparatus for color photographic photosensitive materials which comprises (a) processing tanks comprising a color developing tank, a desilvering tank, a washing tank and/or a stabilizing tank, (b) means for replenishing respective processing tanks, (c) means for controlling an amount of replenishing color developing solution to be charged into the color developing tank such that an amount of overflow liquid from the color developing tank is at most 400 ml per $m^2$ of the processed color photographic photosensitive materials, (d) one storage tank for collecting overflow liquids from all of the processing tanks, (e) means for introducing all overflow liquids from the processing tanks into the storage tank, and (f) means for measuring an amount of processed color photographic photosensitive materials.

2. The apparatus of claim 1 wherein the storage tank has a volume of 100 ml to 50 liters.

3. The apparatus of claim 1 which further comprises (g) means for controlling amounts of replenishing solutions other than the replenishing color developing solution in such that a liquid collected in the storage tank has a silver content of 3 to 20 g/l.

4. The apparatus of claim 1 which further comprises (h) a float sensor which functions as a component of an alarm system for alarming when the storage tank is full.

5. The apparatus of claim 1 wherein it is used for processing color photographic negative films.

6. A processing apparatus for color photographic papers which comprises (a) processing tanks comprising a color developing tank, a desilvering tank, a washing tank and/or a stabilizing tank, (b) means for replenishing respective processing tanks, (c) means for controlling an amount of replenishing color developing solution to be charged into the color developing tank in such that an amount of overflow liquid from the color developing tank is at most 20 ml per $m^2$ of the processed color photographic papers, (d) one storage tank for collecting overflow liquids from all of the processing tanks and (e) means for introducing all overflow liquids from the processing tanks into the storage tank.

7. The apparatus of claim 6 wherein the storage tank has a volume of 100 ml to 50 liters.

8. The apparatus of claim 6 which further comprises (f) means for amounts of replenishing solutions other than the replenishing color developing solution in such that a liquid collected in the storage tank has a silver content of 3 to 20 g/l.

9. The apparatus of claim 6 which further comprises (g) means for measuring an amount of processed photographic papers.

10. The apparatus of claim 6 which further comprises (h) a float sensor which functions as a component of an alarm system for alarming when the storage tank is full.

11. A processing apparatus for color photographic photosensitive materials which comprises (a) two series of processing tanks comprising a color developing tank, a desilvering tank, a washing tank and/or a stabilizing tank, the one being first series for processing color photographic negative films and the other being second series for processing color photographic papers, (b) means for replenishing respective processing tanks, (c-1) means for controlling an amount of replenishing color developing solution to be charged into the color developing tank of the first series such that an amount of overflow liquid from the color developing tank is at most 400 ml per $m^2$ of the processed color photographic negative films, (c-2) means for controlling an amount of replenishing color developing solution to be charged into the color developing tank of the second series such that an amount of overflow liquid from the color developing tank is at most 20 ml per $m^2$ of the processed color photographic papers, (d) one storage tank for collecting overflow liquids from all of the processing tanks, (e) means for introducing all overflow liquids from the processing tanks into the storage tank, and (f-1) means for measuring an amount of processed color photographic negative films and (f-2) means for measuring an amount of processed color photographic papers.

12. The apparatus of claim 11 wherein the storage tank has a volume of 100 ml to 50 liters.

13. The apparatus of claim 11 which further comprises (g) means for amounts of replenishing solutions other than the replenishing color developing solution in such that a liquid collected in the storage tank has a silver content of 3 to 20 g/l.

14. The apparatus of claim 11 which further comprises (h) a float sensor which functions as a component of an alarm system for alarming when the storage tank is full.

15. The apparatus of claim 11 wherein the processing tanks of the first series are common with the corresponding processing tanks of the second series except for respective color developing tanks.

* * * * *

UNITED STATES PATENT AND TRADEMARK OFFICE

CERTIFICATE OF CORRECTION

PATENT NO. : 5,611,077

DATED : March 11, 1997

INVENTOR(S) : Takatoshi ISHIKAWA et al

It is certified that error appears in the above-indentified patent and that said Letters Patent is hereby corrected as shown below:

On title page,

In item [73], delete "FIlm" and insert -- Film --.

Signed and Sealed this

Fifteenth Day of July, 1997

Bruce Lehman

*Attest:*

BRUCE LEHMAN

*Attesting Officer*

*Commissioner of Patents and Trademarks*